US008113622B2

(12) United States Patent
Yamamoto

(10) Patent No.: US 8,113,622 B2
(45) Date of Patent: Feb. 14, 2012

(54) LIQUID EJECTING APPARATUS

(75) Inventor: Taisuke Yamamoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 352 days.

(21) Appl. No.: 12/477,252

(22) Filed: Jun. 3, 2009

(65) Prior Publication Data

US 2009/0303282 A1 Dec. 10, 2009

(30) Foreign Application Priority Data

Jun. 10, 2008 (JP) ..... 2008-151940

(51) Int. Cl.
*B41J 2/165* (2006.01)

(52) U.S. Cl. ..... 347/32

(58) Field of Classification Search ..... 347/32, 347/37

See application file for complete search history.

(56) References Cited

U.S. PATENT DOCUMENTS 5,867,188 A * 2/1999 Murayama et al. ..... 347/37
6,264,304 B1 * 7/2001 Iwaya et al. ..... 347/37
7,390,077 B2 * 6/2008 Miyazaki et al. ..... 347/37

FOREIGN PATENT DOCUMENTS

JP 2007-185869 7/2007

* cited by examiner

*Primary Examiner* — An Do
(74) *Attorney, Agent, or Firm* — Workman Nydeggar

(57) ABSTRACT

A liquid ejecting apparatus includes a nozzle for ejecting liquid and a sealing unit that seals the nozzle. The sealing unit moves between a sealing position for sealing the nozzle in a direction of movement and an off position. A slider guides the sealing unit to the sealing position by moving rectilinearly in one of two opposite directions. The slider guides the sealing unit to the off position by moving in the other of the two directions. A drive mechanism performs first and second movements for moving the slider in the one and the other directions, respectively by a drive force from a motor. A drive force transmitting unit transmits the drive force to the drive mechanism by rotating while engaging the drive mechanism. The drive force transmitting unit rotates in the same direction while transmitting the drive force as the drive mechanism performs the first and second movements.

7 Claims, 17 Drawing Sheets

LIQUID EJECTING APPARATUS

BACKGROUND

1. Technical Field

The present invention relates to a liquid ejecting apparatus.

2. Description of the Related Art

A liquid ejecting apparatus having nozzles for ejecting liquid and a sealing unit for sealing the nozzles is already known. In such the liquid ejecting apparatus, for example, in order to perform a nozzle cleaning operation, when positioning the sealing unit at a sealing position at which the sealing unit seals the nozzles and allowing the nozzles to eject liquid after having ended the cleaning operation, the sealing unit is positioned at an off position apart from the nozzles. In other words, the sealing unit moves between the sealing position and the off position.

In order to move the sealing unit as described above, the liquid ejecting apparatus may be provided with a slide configured to guide the sealing unit to the sealing position by moving rectilinearly one direction from between two directions which are opposite from each other and intersecting the direction of movement, and guide the sealing unit to the off position by moving rectilinearly in the other direction (see JP-A-2007-185869). Also, some of the liquid ejecting apparatuses having the slider have a motor, a drive mechanism executing a first movement to cause the slider to move rectilinearly in the one direction and a second movement to cause the slider to move rectilinearly in the other direction by a drive force from the motor, and a drive force transmitting unit configured to transmit the drive force to the drive mechanism by rotating in a state of engaging the drive mechanism in association with the rotation of the motor.

In the liquid ejecting apparatuses, as described above, the operation to move the sealing unit to the sealing position to cause the sealing unit to seal the nozzles, and the operation to move the sealing unit away from the nozzle are performed as a series of operations. Such the series of operations is required to be performed quickly in order to improve the processing speed of the liquid ejecting apparatus, and hence switching between the respective operations in the series of operations is preferably achieved smoothly. Therefore, switching between the operation to cause the slider to move rectilinearly in the one direction and the operation to cause the slider to move rectilinearly in the other direction, that is, switching of the direction of the rectilinear movement of the slider is preferably performed smoothly.

SUMMARY

An advantage of some aspects of the invention is to make the slider switch the direction of a rectilinear movement thereof smoothly.

According to an aspect of the present invention, a liquid ejecting apparatus includes: a nozzle configured to eject liquid; a sealing unit configured to seal the nozzle, the sealing unit moving between a sealing position for sealing the nozzle in a direction of movement and an off position apart from the nozzle; a slider configured to guide the sealing unit to the sealing position by moving rectilinearly in one direction of two directions which are directions opposite from each other and intersecting the direction of movement and guide the sealing unit to the off position by moving rectilinearly in the other direction; a motor; a drive mechanism configured to perform a first movement for moving the slider rectilinearly in the one direction and a second movement for moving the slider rectilinearly in the other direction by a drive force from the motor; a drive force transmitting unit configured to transmit the drive force to the drive mechanism by rotating in a state of engaging the drive mechanism in association with the rotation of the motor, the drive force transmitting unit rotating in the same direction of rotation both in a case of transmitting the drive force to the drive mechanism when the drive mechanism performs the first movement and in a case of transmitting the drive force to the drive mechanism when the drive mechanism performs the second movement.

In this configuration, the drive force transmitting unit rotates in the same direction of rotation both in the case of transmitting the drive force to the drive mechanism when the drive mechanism performs the first movement and in the case of transmitting the drive force to the drive mechanism when the drive mechanism performs the second movement. In other words, in the liquid ejecting apparatus described above, when the slider switches the direction of rectilinear movement, an operation or time to switch the direction of rotation of the drive force transmitting unit is not required. Therefore, the direction of rectilinear movement of the slider may be switched smoothly.

Preferably, the sealing unit includes a side wall opposing the slider, the side wall includes a projecting portion projecting outward of the side wall, the slider includes a groove cam with which the projecting portion engages, the sealing unit is guided to the sealing position by moving the projecting portion to one end of the groove cam along the groove cam when moving rectilinearly in the one direction, and the sealing unit is guided to the off position by moving the projecting portion to the other end of the groove cam along the groove cam when moving rectilinearly in the other direction. In this configuration, the direction of rectilinear movement of the slider having the groove cam may be switched smoothly.

Preferably, the drive force transmitting unit includes a first cam configured to transmit the drive force to the drive mechanism by rotating in a state of engaging the drive mechanism when the drive mechanism performs the first movement; a second cam configured to transmit the drive force to the drive mechanism by rotating in a state of engaging the drive mechanism when the drive mechanism performs the second movement; and a cam shaft configured to support the first cam and the second cam and rotate integrally with the first cam and the second cam in association with the rotation of the motor, and the drive force transmitting unit rotates in the same direction of rotation both in a case of rotating in the state in which the first cam engages the drive mechanism and a case of rotating in the state in which the second cam engages the drive mechanism. In this configuration, the direction of rectilinear movement of the slider is switched by switching the cam to engage the drive mechanism, and a simple configuration for switching the direction is achieved.

Preferably, while one of the first cam and the second cam engages the drive mechanism, the other cam is positioned apart from the drive mechanism. In this configuration, when one of the cams engages the drive mechanism, the other cam does not interfere, so that the drive mechanism is allowed to perform the first movement and the second movement adequately.

Preferably, the drive mechanism includes: a first rack provided on the slider to be interlocked with the slider; a composite gear having a large gear which engages the first rack and a small gear, the composite gear rotating in a normal direction to cause the first rack to move rectilinearly in the one direction and rotating in a reverse direction to cause the first rack to move rectilinearly in the other direction; a pair of second racks engaging the small gear in a state of opposing to each other, the one second rack moving rectilinearly in the one direction to rotate the composite gear in the normal direction and the other second rack moving rectilinearly in the one direction to rotate the composite gear in the reverse direction, the first cam rotates in a state of engaging the one second rack to cause the one second rack to move rectilinearly in the one direction, and the second cam rotates in a state of engaging the other second rack to cause the other second rack to move rectilinearly in the one direction. When the drive mechanism includes the second racks which engage separately the first cam and the second cam as in this configuration, a configuration to switch the direction of the rectilinear movement of the slider by switching the cam which engages the drive mechanism is further simplified.

Preferably, a suction pump configured to suck the liquid from the nozzle by bringing a space formed between the sealing unit and the nozzle into a negative pressure state is provided when the sealing unit seals the nozzle and the motor is rotatable in both the normal direction and the reverse direction, the cam shaft rotates in association with the rotation of the motor in the normal direction, and the suction pump is activated in association with the rotation of the motor in the reverse direction. According to the embodiment of the invention, the direction of rectilinear movement of the slider is switched while the drive force transmitting unit rotates in a constant direction of rotation. Therefore, the motor for rotating the drive force transmitting unit may also be rotated continuously in the same direction before and after the switching of the direction of the rectilinear movement of the slider. Accordingly, the rotation of the motor in the direction opposite from the direction of rotation when rotating the drive force transmitting unit may be used for activating the suction pump. Consequently, saving of the components in the liquid ejecting apparatus is achieved.

Preferably, an atmosphere release valve configured to bring the space in the negative pressure state into an atmosphere release state, a third cam configured to open the atmosphere release valve by rotating in a state of engaging the atmosphere release valve are provided, and the third cam being supported by the cam shaft rotates integrally with the cam shaft and engages the atmosphere release valve wile the first cam and the second cam are apart from the drive mechanism. Since a timing when the first cam or the second cam rotate while engaging the drive member and a timing when the third cam rotates while engaging the atmosphere release valve are differentiated, a load applied to the cam shaft (torque load) may be reduced in comparison with a configuration in which the two timings are overlapped with each other.

Other features of the invention will be apparent by descriptions in the specification and the attached drawings.

BRIEF DESCRIPTION OF THE DRAWINGS

The invention will be described with reference to the accompanying drawings, where like numbers reference like elements.

DESCRIPTION OF EXEMPLARY EMBODIMENTS

Liquid Ejecting Apparatus

Hereinafter, an ink jet printer (hereinafter referred to as a printer 11) will be described as an example of a liquid ejecting apparatus in the invention.

Basic Configuration of Printer 11

Figure 1:
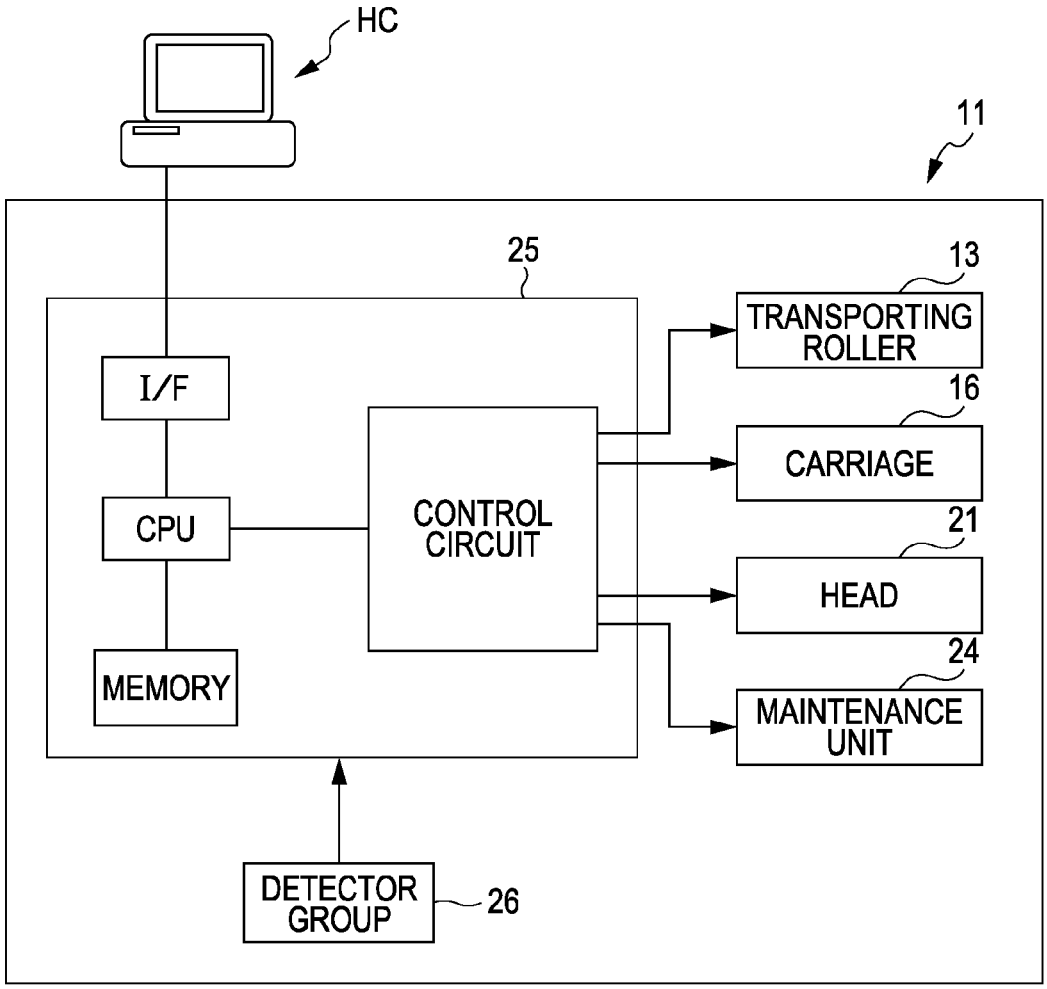
FIG. 1 is a block diagram showing a configuration of a printer 11.
Figure 2:
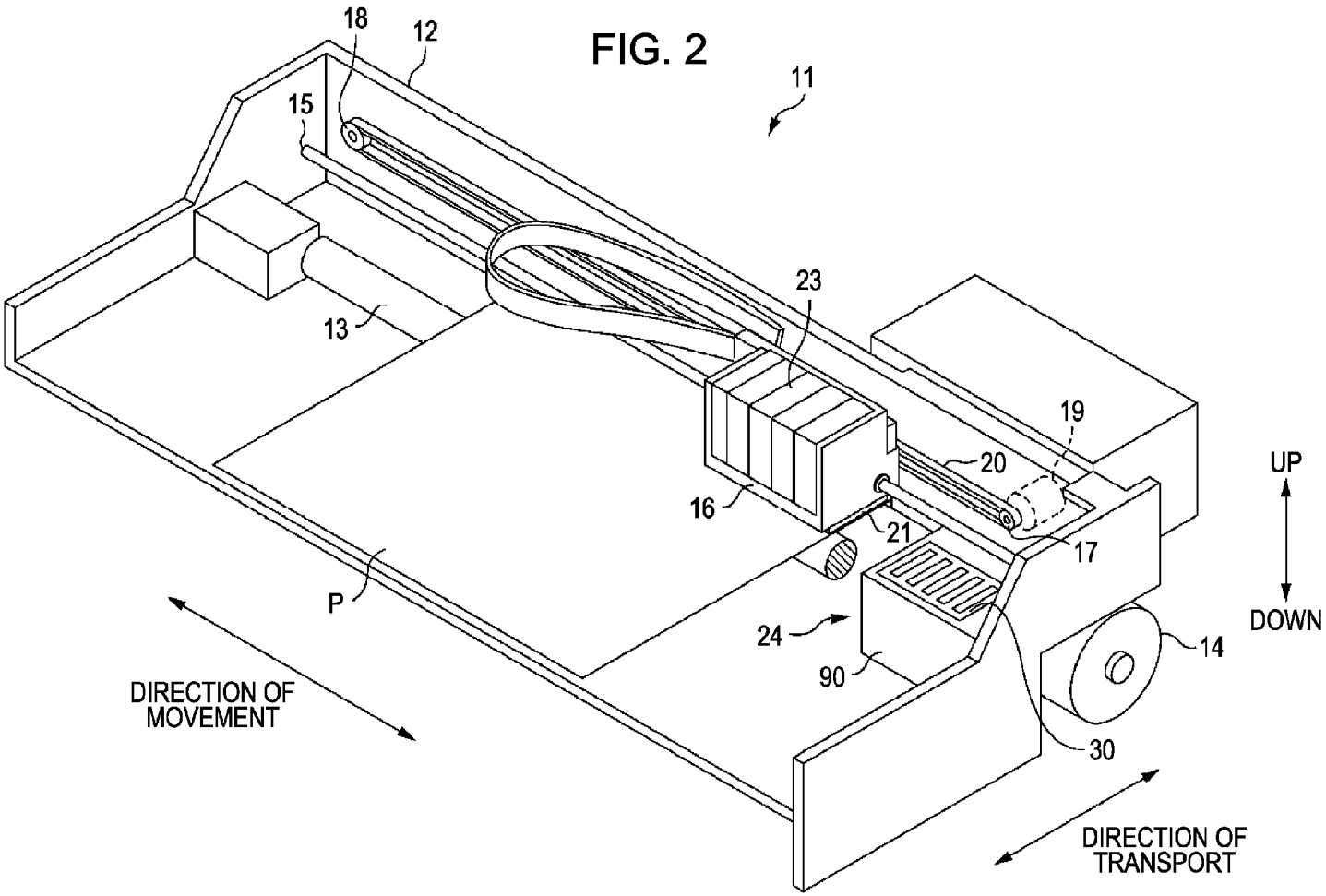
FIG. 2 is a drawing showing a general configuration of the printer 11 schematically.
Figure 3:
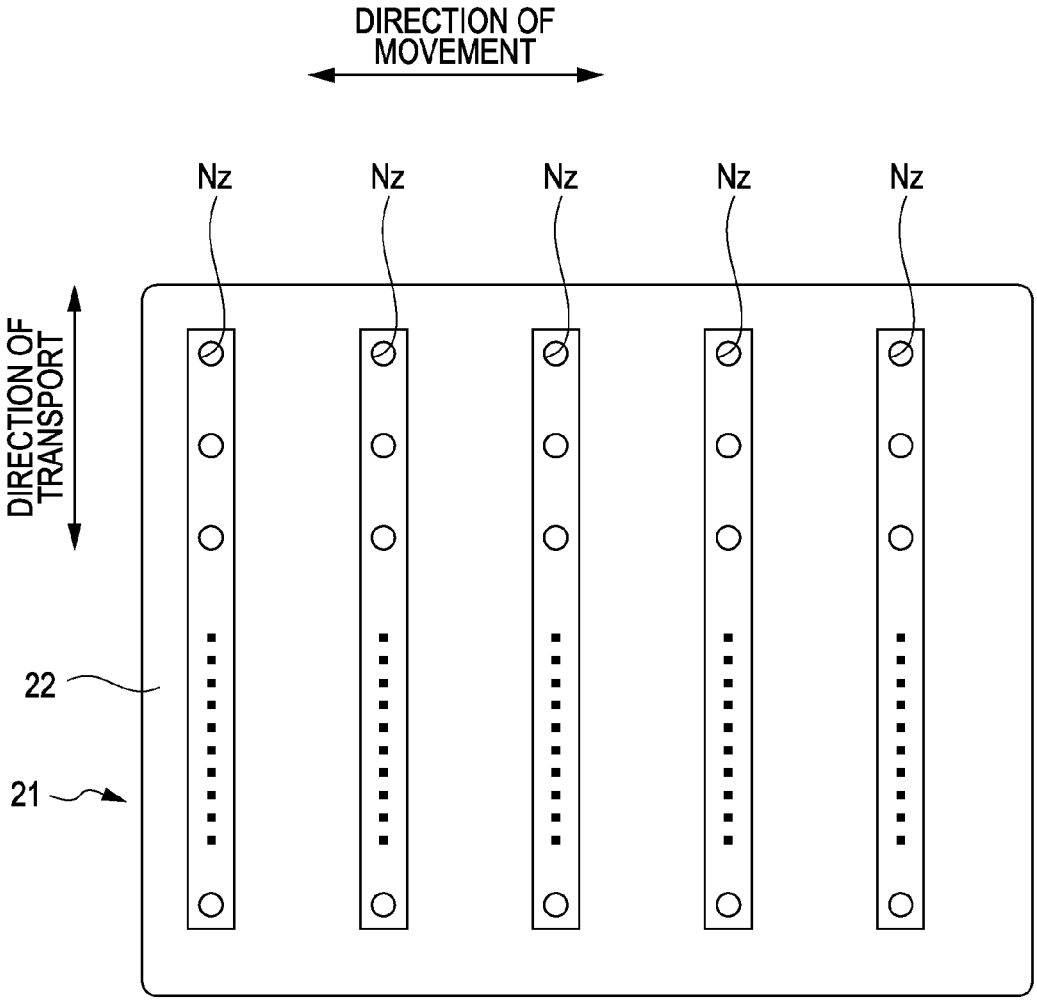
FIG. 3 is a drawing showing an array of nozzles Nz in a nozzle surface 22.

Referring now to FIGS. 1 to 3, the basic configuration of the printer 11 according to the embodiment will be described. FIG. 1 is a block diagram showing a configuration of the printer 11. FIG. 2 is a drawing schematically showing a general configuration of the printer 11 and, in the drawing, a vertical direction of the printer 11, a direction of transport of a recording medium P, and a direction of movement of a carriage 16 are shown by arrows. FIG. 3 is a drawing showing an array of nozzles Nz in a nozzle surface 22 and, in the drawing, the direction of transport of the recording medium P and the direction of movement of the carriage 16 are shown by arrows.

The printer 11 is a printing apparatus configured to print an image on the recording medium P by receiving print data from a host computer HC and ejecting ink as liquid on the recording medium P on the basis of the print data. In the embodiment, the printer 11 includes a transporting roller 13, the carriage 16, a head 21, a maintenance unit 24, and a printer controller 25 as main components as shown in FIG. 1 and FIG. 2.

The transporting roller 13 is a roller which rotates about a revolving shaft along the direction of movement of the carriage 16 inside a frame 12 of the printer 11. The transporting roller 13 is rotated by a drive force of a transporting motor 14 in sliding contact with the recording medium P with an outer peripheral surface thereof and transports the recording medium P in the direction of transport.

The carriage 16 reciprocates along a guide shaft 15 which supports the carriage 16 in the frame 12 to transfer the head 21 mounted on the carriage 16 in the direction of movement of the carriage 16. As shown in FIG. 2, in order to move the carriage 16, a drive pulley 17, a driven pulley 18, a drive motor 19 configured to drive the drive pulley 17, and a timing belt 20 extended between the two pulleys are provided. The timing belt 20 is fixedly supported by the carriage 16, and the carriage 16 moves in the direction of movement thereof by the rotation of the timing belt 20.

The head 21 includes a plurality of the nozzles Nz formed on a lower surface (that is, the nozzle surface 22) and is configured to eject ink from the nozzles Nz toward the recording medium P. As shown in FIG. 3, on the nozzle surface 22, the plurality of nozzles Nz are arranged at a regular pitch along the direction of transport and form nozzle rows. The printer 11 in this embodiment is a color ink jet printer ejecting ink in five colors, and the nozzle rows are formed for the respective colors of the ink. The nozzles Nz each include an ink chamber and a piezoelectric element, not shown, and drops of ink are ejected from the nozzle Nz by the ink chamber contracting and expanding by the operation of the piezoelectric element.

A plurality of (for five colors in this embodiment) ink cartridges 23 for supplying ink to the head 21 are provided and, in this embodiment, the respective ink cartridges 23 are demountably mounted on the carriage 16 as shown in FIG. 2. However, the configuration in which the ink cartridges 23 are mounted on the carriage 16 is not limited, and a configuration in which the ink cartridges 23 are mounted outside the carriage 16 is also applicable.

The maintenance unit 24 performs a cleaning operation for the nozzles Nz for maintaining ejection of ink from the nozzles Nz in a good condition. The cleaning operation is an operation to restrain clogging of the nozzles Nz caused by ink increased in viscosity near openings of the nozzles Nz, and discharge ink in the nozzles Nz for removing dusts or air bubbles mixed in the ink. When the cleaning operation is performed, the head 21 is positioned at a position (home position) at an end portion within a range of movement (in FIG. 2, the other end portion in the direction of movement of the carriage 16) where the recording medium P is not placed. The maintenance unit 24 described above is arranged so as to be positioned below the head 21 when the head 21 is positioned at the home position within the frame 12, and collects ink (waste ink) discharged from the nozzles Nz by the cleaning operation or a flushing operation, described later. A configuration of the maintenance unit 24 will be described later in detail.

The printer controller 25 is configured to control the respective components (that is, the transporting roller 13, the carriage 16, the head 21, and the maintenance unit 24) via a control circuit on the basis of the print data transmitted from the host computer HC. The state in the printer 11 is monitored by a detector group 26, and the detector group 26 outputs signals according to the result of detection to the printer controller 25.

Configuration of Maintenance Unit 24

Figure 4:
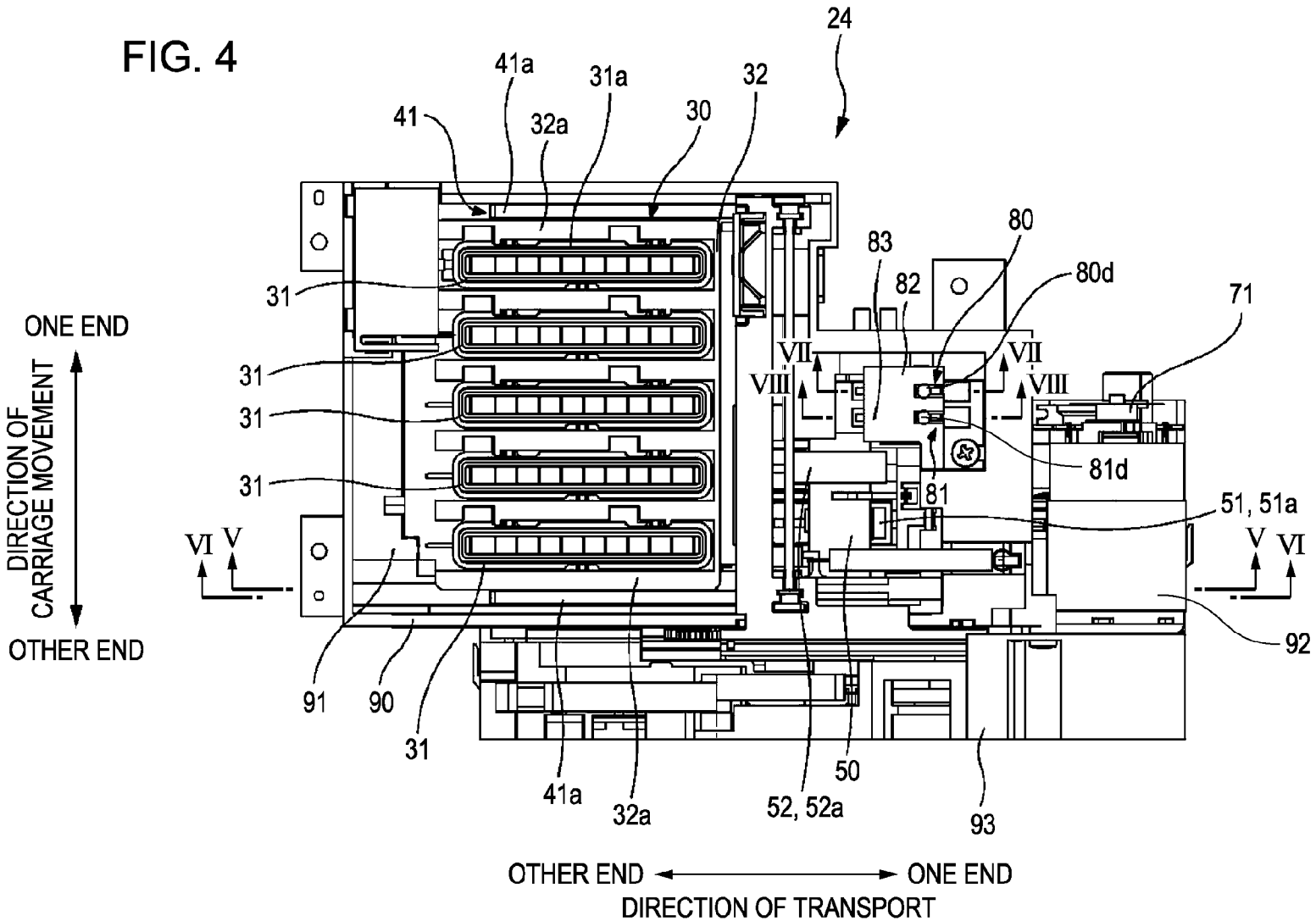
FIG. 4 is a drawing of a maintenance unit 24 when viewed from above.
Figure 5:
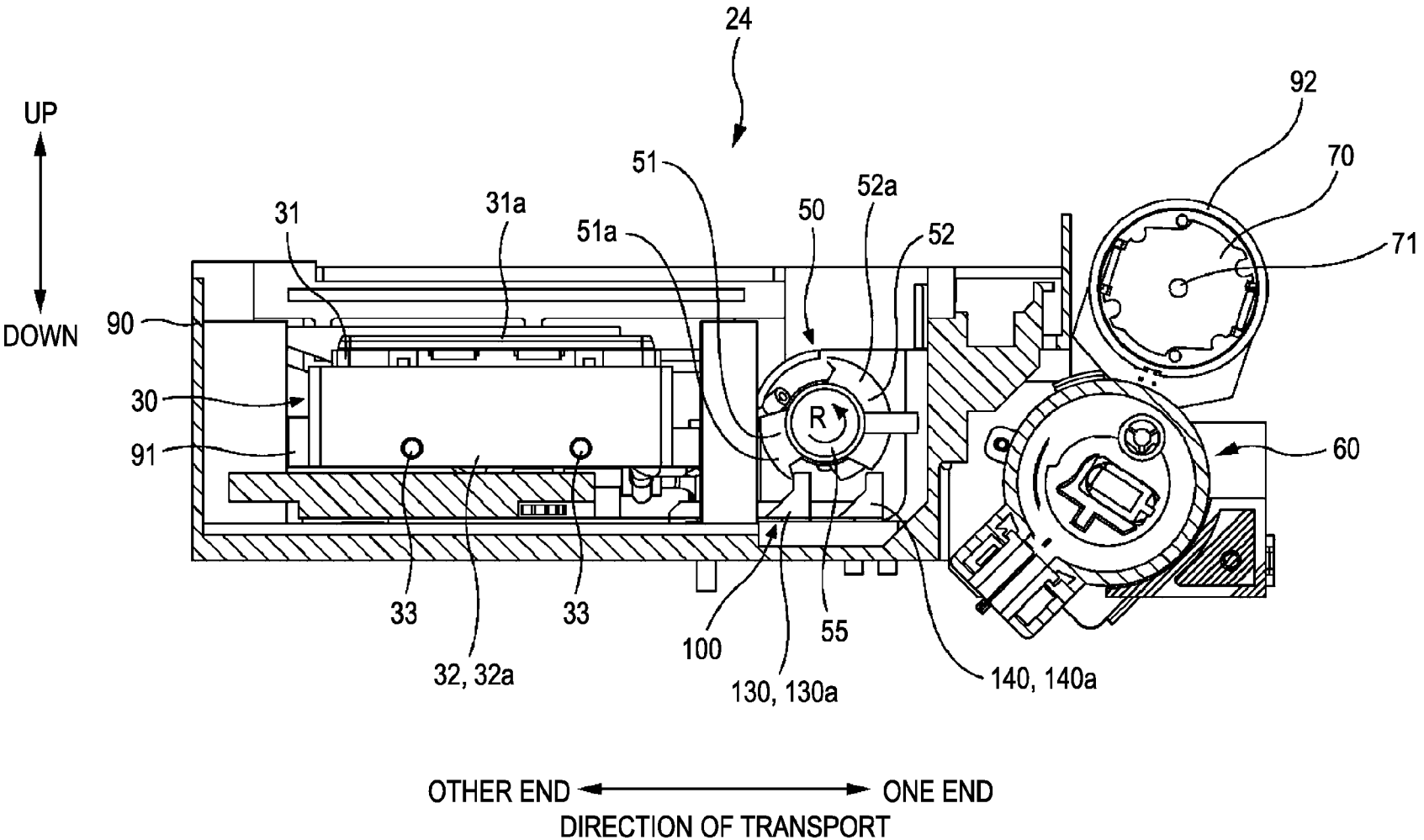
FIG. 5 is a cross-sectional view taken along the line V-V in FIG. 4.
Figure 6:
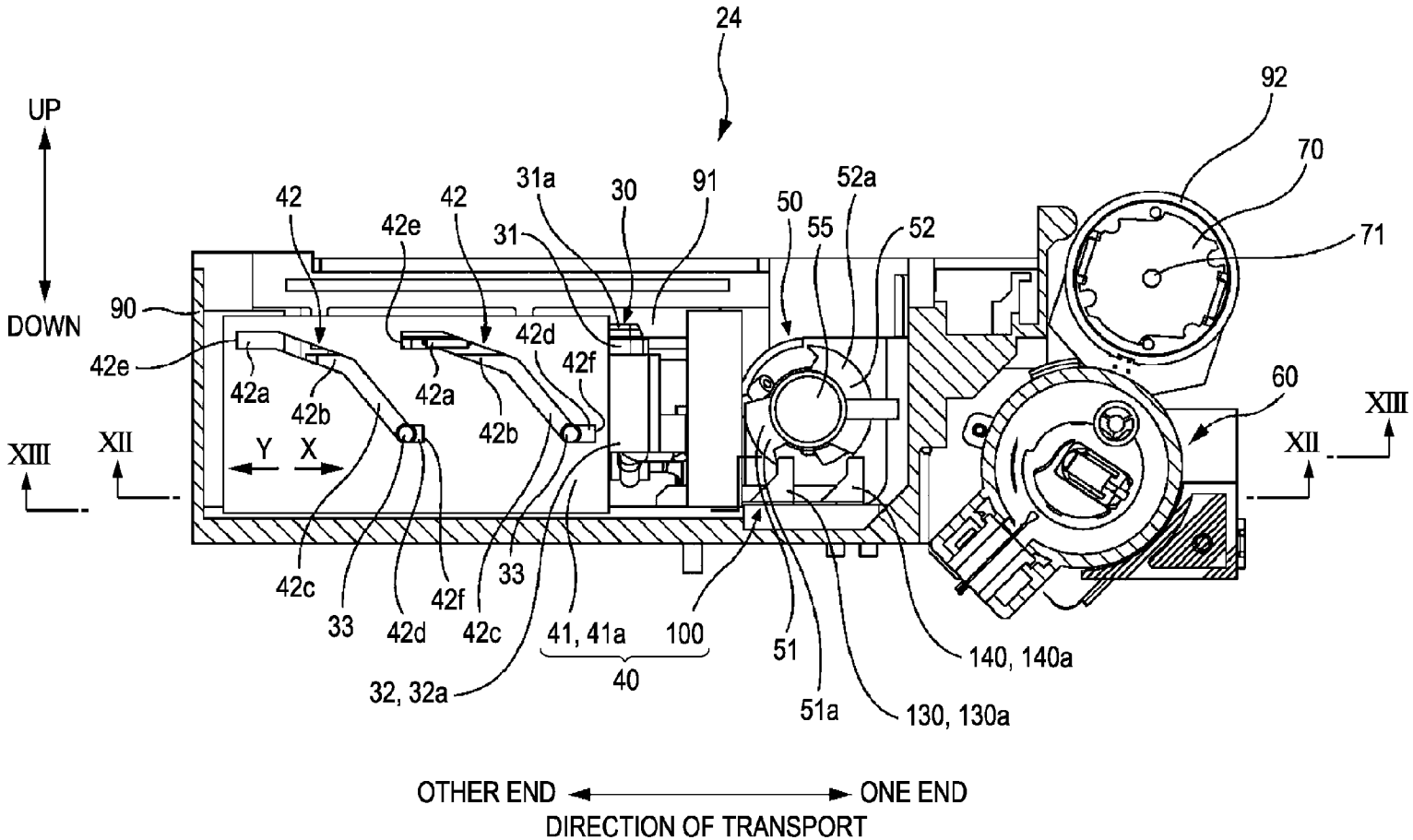
FIG. 6 is a cross-sectional view taken along the line VI-VI in FIG. 4.
Figure 7:
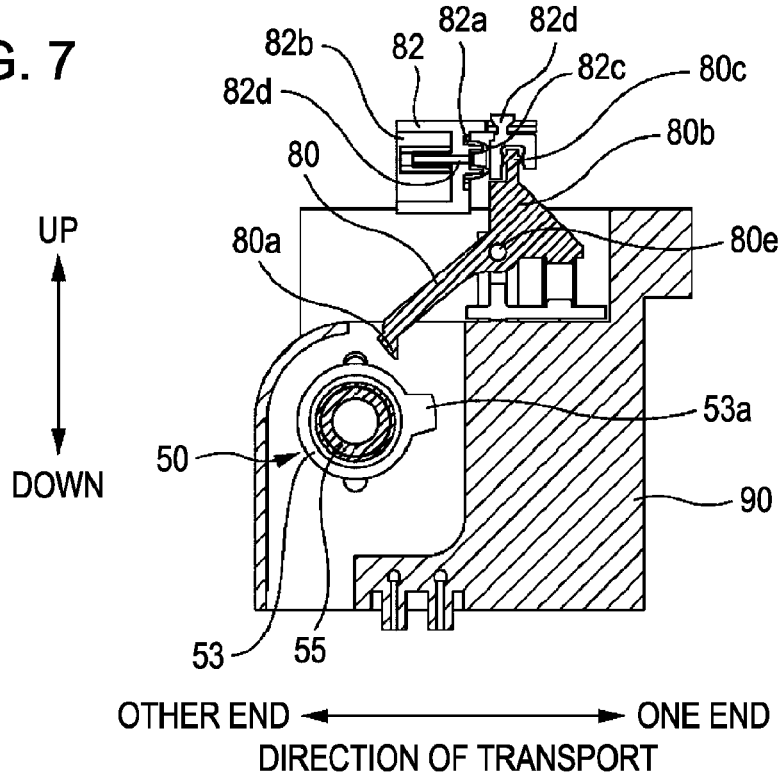
FIG. 7 is a cross-sectional view taken along the line VII-VII in FIG. 4.
Figure 8:
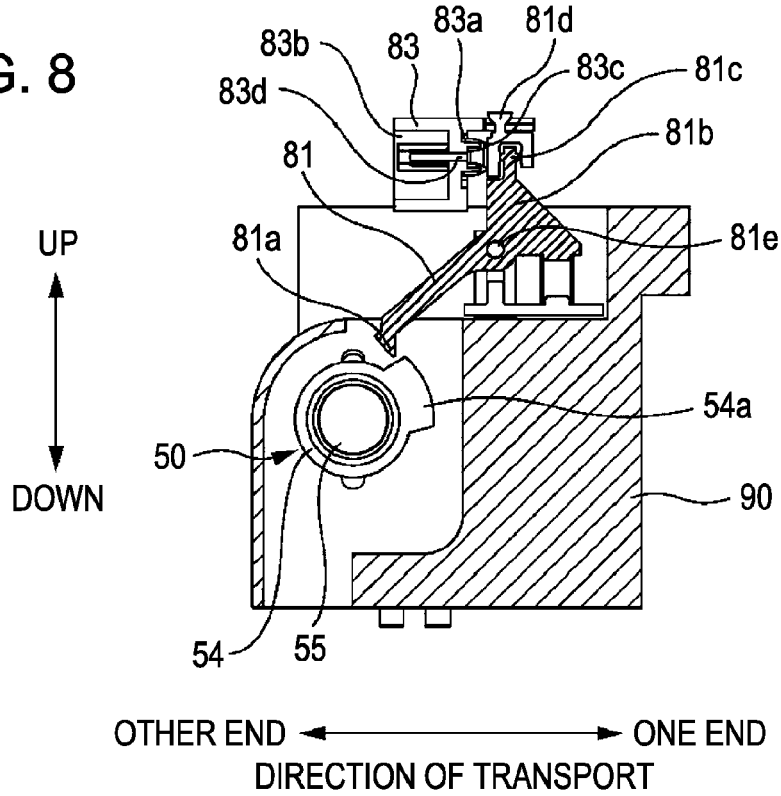
FIG. 8 is a cross-sectional view taken along the line VIII-VIII in FIG. 4.

Subsequently, referring to FIG. 4 to FIG. 8, a configuration of the maintenance unit 24 will be described. FIG. 4 is a drawing of the maintenance unit 24 when viewed from above and, in the drawing, a direction corresponding to the direction of movement of the carriage 16 (the direction of movement of the carriage in the drawing) and a direction corresponding to the direction of transport of the recording medium P (direction of transport in the drawing) are shown by arrows. FIG. 5 to FIG. 8 are cross-sectional views of FIG. 4. FIG. 5 is a cross-sectional view taken along the line V-V, FIG. 6 is a cross-sectional view taken along the line VI-VI, FIG. 7 is a cross-sectional view taken along the line VII-VII, and FIG. 8 is a cross section taken along the line VIII-VIII, respectively. In the respective drawings from FIG. 5 to FIG. 8, the vertical direction and directions corresponding to the direction of transport of the recording medium P (direction of transport in the drawings) are indicated by arrows.

As shown in FIG. 4 to FIG. 7, the maintenance unit 24 includes a cap unit 30 as a sealing unit, a cap elevating unit 40, a cam unit 50 as a drive force transmitting unit, suction pumps 60, a drive motor 70, and two atmosphere release valves 80 and 81.

The cap unit 30 is configured to come into contact with the nozzle surface 22 of the head 21 in a state of being positioned at the home position to close the nozzles Nz (more specifically, the openings of the nozzles Nz) when performing the cleaning operation described above. The cap unit 30 is stored in a cap unit chamber 91 formed in a casing 90 of the maintenance unit 24 as shown in FIG. 4.

The cap unit 30 includes substantially box-shaped cap members 31 each formed with a square opening on top surface, and a cap holder 32 for storing the cap members 31 as shown in FIGS. 4 and 5. The cap holder 32 accommodates a plurality of (five in this embodiment) the cap members 31 so as to correspond to the plurality of nozzle rows formed on the nozzle surface 22 respectively. The plurality of cap members 31 are arranged along the longitudinal direction (that is, the direction corresponding to the direction of movement of the carriage 16) of the cap holder 32 as shown in FIG. 4.

As shown in FIG. 4 and FIG. 5, the cap members 31 each include a rubber-made seal member 31*a* which surrounds the opening formed on top surface thereof. Then, the cap unit 30 seals the nozzles Nz by bringing the seal members 31*a* of the respective cap members 31 into tight contact with the nozzle surface 22 so as to surround the nozzle rows corresponding to the respective cap members 31. When the seal members 31*a* come into tight contact with the nozzle surface 22, recessed-shaped spaces are formed between the nozzles Nz and the cap unit 30. In other words, when the seal members 31*a* come into tight contact with the nozzle surface 22, spaces surrounded by the nozzle surface 22 and the cap members 31 are formed immediately below the openings of the nozzles Nz. The spaces serve as spaces for receiving waste ink ejected from the nozzles Nz by the cleaning operation and, are referred to as waste ink receiving spaces. Forming the waste ink receiving spaces to bring the cap unit 30 into a state in which the cleaning operation (that is, sucking action of waste ink) is performable, or into a state in which evaporation of ink from the nozzles Nz is restrained is referred to as "sealing".

What is essential is to bring the state of the cap unit 30 in the above-described state (that is, a state in which the nozzles Nz are sealed) and, for example, a state in which the cap unit 30 seals the nozzles Nz in a state in which the seal members 31*a* are in tight contact with portion other than the nozzle surface 22 is also applicable. Also, in the state in which the cap unit 30 seals the nozzles Nz, the waste ink receiving spaces may be closed spaces by being partitioned by the nozzle surface 22 and the cap members 31 (that is, airtight spaces), or may not be the closed spaces.

The cap unit 30 is able to reciprocate in the vertical direction in the cap unit chamber 91 by the cap elevating unit 40. In other words, the vertical direction corresponds to the direction of movement of the cap unit 30 in this embodiment. In a stroke of movement where the cap unit 30 moves in the vertical direction, when the cap unit 30 reaches an upper end (that is, a top dead center), the cap unit 30 comes into contact with the nozzle surface 22 of the head 21 at the home position and seals the nozzles Nz. The upper end of the stroke of movement corresponds to a sealing position. In contrast, in the stroke of movement as described above, when the cap unit 30 reaches a lower end (that is, a bottom dead center), the cap unit 30 is apart from the nozzles Nz, and is positioned at a farthest position from the nozzles Nz. The lower end of the stroke of movement corresponds to an off position. In a state in which the cap unit 30 is positioned at the off position, the head 21 is movable in the direction of movement (the direction of movement of the carriage 16) without being interfered by the cap unit 30.

The cap elevating unit 40 is configured to make the cap unit 30 reciprocate in the vertical direction, and includes a slider 41 and a slider drive mechanism 100 shown in FIG. 6.

Figure 12:
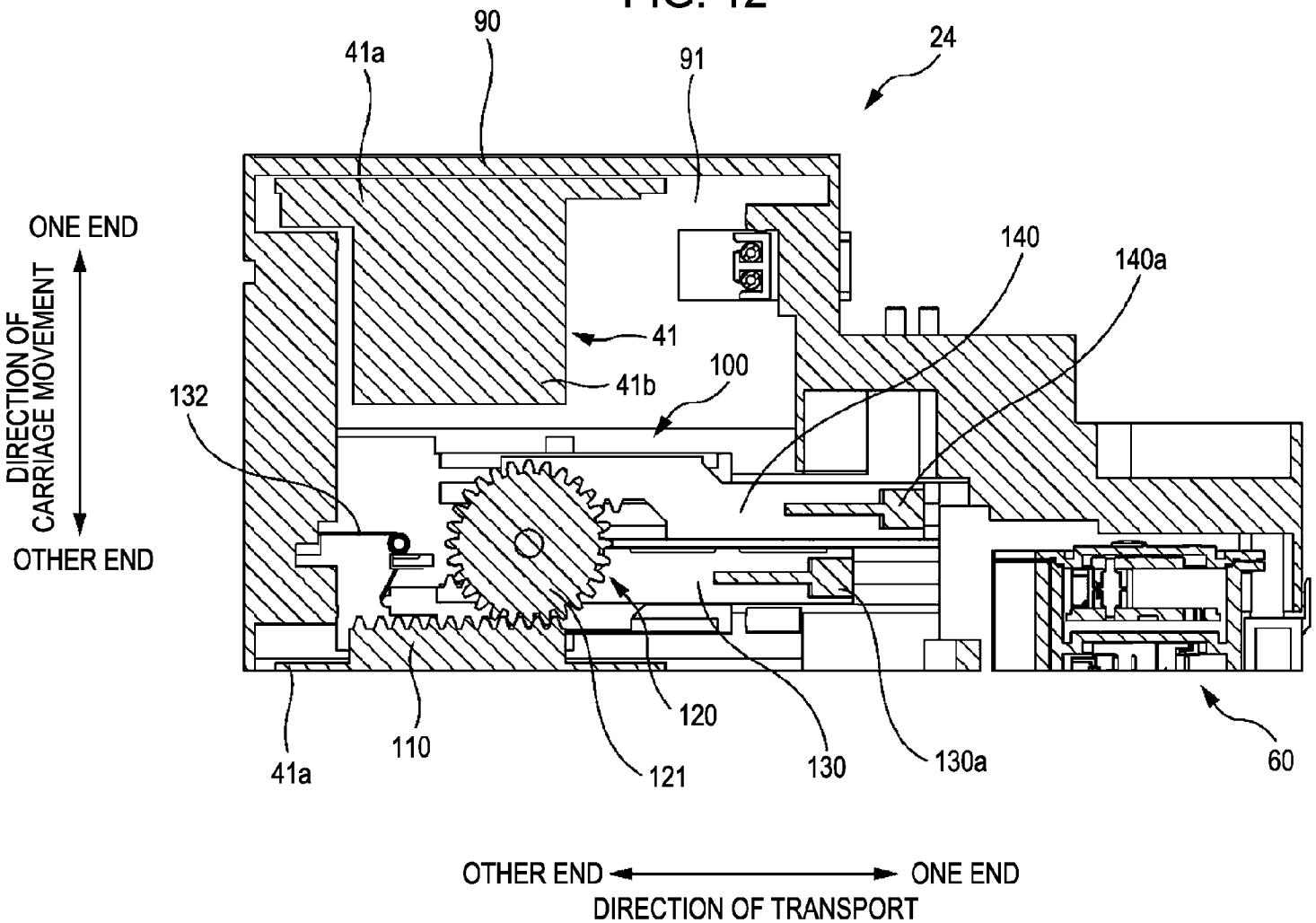
FIG. 12 is a first explanatory drawing showing a configuration of a slider drive mechanism 100.

The slider 41 is a substantially H-shaped resin mold member having a pair of rectangular plate-shaped vertical portions 41*a* being upright substantially vertically outsides both ends of the cap holder 32 in the longitudinal direction (see FIG. 6), and a horizontal portion 41*b* arranged between the vertical portions 41*a* at a position slightly above lower ends of the respective vertical portions 41*a* (see FIG. 12). The slider 41 is stored in the cap unit chamber 91 in a state in which the horizontal portion 41*b* is positioned below the cap holder 32. Then, the slider 41 is rectilinearly reciprocated in a direction intersecting the vertical direction (a horizontal direction in this embodiment, more specifically, the direction corresponding to the direction of transport of the recording medium P). By the rectilinear movement of the slider 41, the cap unit 30 reciprocates between the sealing position and the off position in the vertical direction.

More specifically, the cap holder 32 includes side walls 32*a* opposing the slider 41 (more specifically, the vertical portions 41*a* of the slider 41) at the both end portions in the longitudinal direction. The side walls 32*a* each include column-shaped projecting portions 33 projecting outwardly of the respective side walls 32*a* as shown in FIG. 5. In contrast, the vertical portions 41*a* of the slider 41 are each formed with groove cams 42 to which the projecting portions 33 engage as shown in FIG. 6. The groove cams 42 each include a portion inclined with respect to the horizontal direction. The groove cam 42 is formed in such a manner that one groove cam end 42*e* (an end positioned on the other end side in the direction corresponding to the direction of transport of the recording medium P) is positioned above the other groove cam end 42*f* (an end positioned on one end side in the direction corresponding to the direction of transport of the recording medium P) and the distance between the one groove cam end 42*e* and the other groove cam end 42*f* in the vertical direction is equal to the distance between the sealing position and the off position in the vertical direction. By the engagement (more specifically, fitted engagement) of the projecting portions 33 with the groove cams 42, the slider 41 supports the cap unit 30 in such a manner that the projecting portions 33 are slidable in the groove cams 42.

The pair of vertical portions 41*a* of the slider 41 in this embodiment are each formed with the two groove cams 42 having the same shape as shown in FIG. 6, and a positional relationship between the two groove cams 42 is a relationship achieved by being translated in the longitudinal direction (a direction along the direction corresponding to the direction of transport of the recording medium P) of the vertical portions 41*a* of the slider 41. The side walls 32*a* of the cap holder 32 have two each of projecting portions 33 and the projecting portions 33 engage the corresponding groove cams 42.

Figure 9:
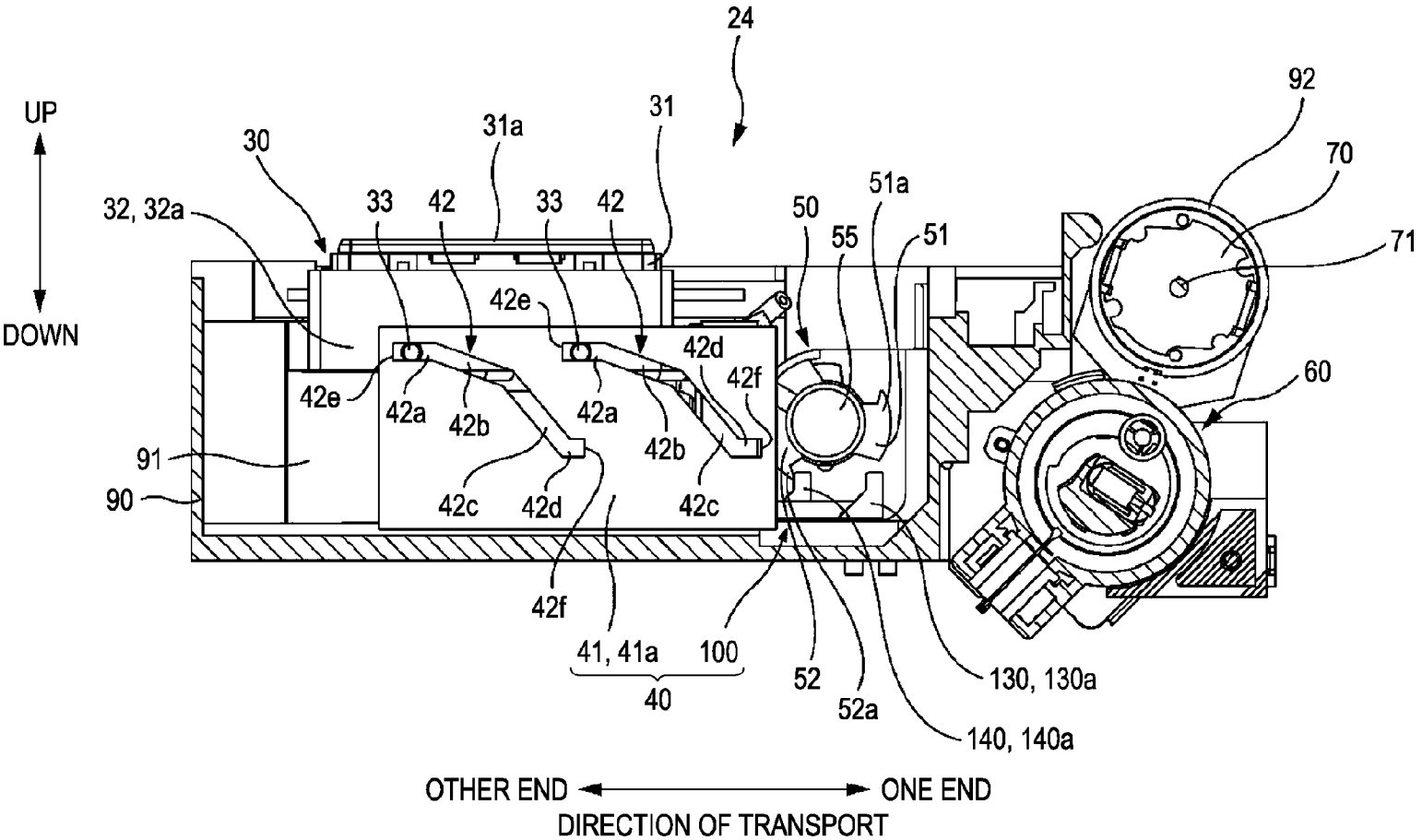
FIG. 9 is a drawing showing a state in which a cap unit 30 is positioned at a sealing position.

When the slider 41 having the groove cams 42 as described above moves rectilinearly in the direction from the other end to one end in the direction corresponding to the direction of transport of the recording medium P (in FIG. 6, the direction indicated by an arrow X and is referred to as one direction, hereinafter), the projecting portions 33 slide in the groove cams 42 along the groove cams 42 toward the one groove cam ends 42*e*. At this time, since the projecting portions 33 are pushed upward by the bottom portions of the groove cams 42, the entire cap unit 30 including the cap holder 32 moves upward. Then, when the slider 41 continues to move rectilinearly and moves the projecting portions 33 finally to the one groove cam ends 42*e*, the cap unit 30 reaches the sealing position as shown in FIG. 9. FIG. 9 is a drawing showing a state in which the cap unit 30 is positioned at the sealing position. FIG. 6 and FIG. 9 correspond to each other, and FIG. 6 shows a state in which the cap unit 30 is positioned at the off position.

In the same manner, when the slider 41 moves rectilinearly in the direction from the one end to the other end in the direction corresponding to the direction of transport of the recording medium P (in FIG. 6, the direction indicated by an arrow Y and is referred to as the other direction, hereinafter), the projecting portions 33 are caused to move to the other groove cam ends 42*f* along the groove cams 42. At this time, the projecting portions 33 slide in the groove cams 42 as if they drop down along the groove cams 42, and hence the entire cap unit 30 moves downward. As shown in FIG. 7 and FIG. 8, substantially cylindrical shaped tube supporting portions 82*b* and 83*b* are formed on the opposite side of the lip portions 82*a* and 83*a* with the intermediary of the inner walls of the valve seat forming members 82 and 83. Then, when the projecting portions 33 move to the other groove cam ends 42*f*, as shown in FIG. 6, the cap unit 30 reaches the off position.

As described above, the slider 41 guides the cap unit 30 to the sealing position by moving rectilinearly in the one direction, and guides the cap unit 30 to the off position by moving rectilinearly in the other direction. Here, the one direction and the other direction are opposite directions from each other, and are two directions intersecting the vertical direction, which is the direction of movement of the cap unit 30.

The groove cams 42 according to the embodiment will be described in further detail. As shown in FIG. 6, upper horizontal grooves 42*a*, gently inclined grooves 42*b*, steeply inclined grooves 42*c*, and lower horizontal grooves 42*d* are arranged in sequence from the one groove cam ends 42*e* to the other groove cam ends 42*f*. The upper horizontal grooves 42*a* are portions for holding the cap unit 30 in the sealing position. The lower horizontal grooves 42*d* are portions for holding the cap unit 30 in the off position. The gently inclined grooves 42*b* and the steeply inclined grooves 42*c* are both inclined with respect to the horizontal direction, and are portions to move the cap unit 30 in the vertical direction by sliding the projecting portions 33 of the cap holder 32 in the interiors thereof.

Then, the angle of inclination of the gently inclined grooves 42*b* positioned on the sides of the one groove cam ends 42*e* is smaller than the angle of inclination of the steeply inclined grooves 42*c*. It is for reducing a load applied to equipment (for example, the slider 41 or the slider drive mechanism 100) for elevating the cap unit 30 when bringing the cap unit 30 into contact with the nozzle surface 22 by elevating the cap unit 30 to the sealing position (more specifically, when bringing the seal members 31*a* into tight contact with the nozzle surface 22). More specifically, the load is inevitably generated when securing a contact pressure between the cap unit 30 and the nozzle surface 22, and is increased with increase in speed to bring the cap unit 30 into contact with the nozzle surface 22 (elevating speed). Therefore, in this embodiment, the load is alleviated by moving the cap unit 30 gently by designing the angle of inclination of the groove cams 42 where the projecting portions 33 pass to be gentle immediately before the cap unit 30 comes into contact with the nozzle surface 22.

The slider drive mechanism 100 is a drive mechanism for rectilinearly moving the slider 41 and performs a first movement for moving the slider 41 rectilinearly in the one direction and a second movement for moving the slider 41 rectilinearly in the other direction by a drive force transmitted from the drive motor 70. The detailed description of the slider drive mechanism 100 will be given later.

The cam unit 50 is configured to transmit the drive force from the drive motor 70 to the slider drive mechanism 100 by rotating in a state of engaging the slider drive mechanism 100 in association with the rotation of the drive motor 70. The cam unit 50 in this embodiment has a function to open the atmosphere release valves 80 and 81 by rotating in a state of engaging the atmosphere release valves 80 and 81. Then, the cam unit 50 includes a first cam 51, a second cam 52, two third cams 53 and 54, and a cam shaft 55 for supporting these cams as shown in FIG. 5 to FIG. 8. The axial direction of the cam shaft 55 extends along the direction corresponding to the direction of movement of the carriage 16 and, the one third cam 53, the other third cam 54, the second cam 52, and the first cam 51 are arranged in sequence from an axially one end (one end of the direction corresponding to the direction of movement of the carriage 16) of the cam shaft 55 in the axial direction.

As shown in FIG. 5 or FIG. 6, the first cam 51 and the second cam 52 are cams having engaging portions 51*a* and 52*a* projecting in a hook shape. The first cam 51 transmits the drive force from the drive motor 70 to the slider drive mechanism 100 by rotating in a state of engaging the slider drive mechanism 100 (more specifically, an engaged portion 130*a* of an elevating rack 130, described later) when the slider drive mechanism 100 performs the first movement. In other words, the first cam 51 is a cam for causing the slider drive mechanism 100 to perform the first movement. The second cam 52 transmits the drive force from the drive motor 70 to the slider drive mechanism 100 by rotating in a state of engaging the slider drive mechanism 100 (more specifically, an engaged portion 140*a* of a lowering rack 140, described later) when the slider drive mechanism 100 performs the second movement. In other words, the second cam 52 is a cam for causing the slider drive mechanism 100 to perform the second movement.

The two third cams 53 and 54 are cams having the engaging portions 53*a* and 54*a* projecting in a projecting shape as shown in FIG. 7 and FIG. 8 respectively. The third cams 53 and 54 open the corresponding atmosphere release valves 80 and 81 by rotating in a state of engaging the corresponding atmosphere release valves 80 and 81 (more specifically, the engaged portions 80*a* and 81*a* of the atmosphere release valves 80 and 81).

The cam shaft 55 rotates integrally with the first cam 51, the second cam 52, and the two third cams 53 and 54 when the drive motor 70 rotates (more specifically, when the drive motor 70 rotates in the normal direction as described above). Then, the cam shaft 55 according to the embodiment rotates always in a constant direction of rotation when rotating (the direction indicated by an arrow R in FIG. 5). Therefore, the direction of rotation of the entire cam unit 50 including the cam shaft 55 is always the constant direction.

The suction pumps are devices configured to suck ink from the nozzles Nz during the cleaning operation (that is, the ink in the nozzles Nz is forcedly discharged from the nozzles Nz). The suction pumps 60 in this embodiment are tube pumps each including a revolving shaft, not shown, and performing a sucking action by the rotating revolving shaft.

The suction pumps 60 suck air in internal spaces in the interiors of the cap members 31 through connecting tubes connected to the internal spaces of the cap members 31. In other words, when the cap unit 30 comes into contact with the nozzle surface 22 of the head 21 and the waste ink receiving spaces are formed between the nozzles Nz and the cap unit 30, the suction pumps 60 suck air in the waste ink receiving spaces. Accordingly, the waste ink receiving spaces assume a negative pressure state. Consequently, the suction pumps 60 suck ink in the nozzles Nz from the nozzles (in other words, the waste ink receiving spaces receive the waste ink). Also, when the waste ink receiving spaces are brought from the negative pressure state to an atmosphere release state during the operation of the suction pumps 60, the suction pumps 60 suck air in the waste ink receiving spaces but does not suck ink in the nozzles Nz (so-called opened suction). At this time, when the waste ink is stored in the waste ink receiving spaces, the suction pumps 60 suck waste ink from the waste ink receiving spaces and deliver the waste ink to a waste ink tank, not shown.

In this embodiment, there are provided two such suction pumps 60 (only one of the suction pumps 60 is shown in FIG. 5 or FIG. 6 for the convenience of representation in the drawings). One of the two suction pumps 60 corresponds to the cap member 31 positioned closest to the one end of the cap holder 32 in the longitudinal direction (hereinafter, referred to as the cap member 31 at one end) and the other suction pump 60 corresponds to the remaining cap members 31. In other words, one of the suction pumps 60 sucks air in the internal space of the cap member 31 at the one end and the other suction pump 60 sucks air in the internal spaces of the remaining cap members 31 respectively.

The drive motor 70 is a motor as a common drive source for the cam unit 50 and the suction pumps 60. The drive motor 70 and a drive shaft 71 connected directly to the drive motor 70 are stored in a motor box 92, and the motor box 92 is arranged in parallel with the casing 90 on one end side in a direction corresponding to the direction of transport of the recording medium P as shown in FIG. 4. The drive motor 70 and the drive shaft 71 in this embodiment are rotatable both in the normal direction and the reverse direction.

The drive shaft 71 is interlocked with the above-described cam shaft 55 via a gear train (not shown) stored in a gear box 93 shown in FIG. 4. In this embodiment, a one-way clutch is formed at a final stage of the gear train. In this embodiment, with the one-way clutch, when the drive motor 70 rotates in the normal direction, the cam unit 50 including the cam shaft 55 rotating in association with the rotation of the drive motor 70. In contrast, when the drive motor 70 rotates in the reverse direction, the cam unit 50 does not rotate. The drive shaft 71 is interlocked also with the revolving shafts of the respective suction pumps 60, and one-way clutches are formed at final stages of transmission mechanisms (not shown) provided between the drive shaft 71 and the revolving shafts of the respective suction pumps 60. With the one-way clutches, in this embodiment, when the drive motor 70 rotates in the reverse direction, the drive force of the drive motor 70 is transmitted to the suction pumps 60 via the drive shaft 71 and the revolving shafts of the suction pumps 60, so that the suction pumps 60 are activated. In contrast, when the drive motor 70 rotates in the normal direction, the suction pumps 60 are not driven. In this embodiment, when the drive motor 70 rotates in the reverse direction, both of the two suction pumps 60 are activated simultaneously.

In this manner, in this embodiment, the drive source of the cam unit 50 and the drive source of the suction pumps 60 are common, so that the simplification of devices in the printer 11 (more specifically, the maintenance unit 24 of the printer 11) is achieved.

The two atmosphere release valves 80 and 81 are valves to communicate the internal spaces of the cap members 31 with the atmosphere when released. In other words, the atmosphere release valves 80 and 81 restore the waste ink receiving spaces described above to the atmosphere release state by releasing the above-described waste ink receiving spaces in the negative pressure state. In this embodiment, the atmosphere release valve 80, which is one of the two atmosphere release valves 80 and 81, corresponds to the cap member 31 at the one end, and the other atmosphere release valve 81 corresponds to the remaining cap members 31.

The atmosphere release valves 80 and 81 are members of an elongated lever shape as shown in FIG. 7 and FIG. 8. At one end portions of the respective atmosphere release valves 80 and 81 in the longitudinal direction, the hook-shaped engaged portions 80*a* and 81*a* are formed as shown in FIG. 7 and FIG. 8. The engaged portions 80*a* and 81*a* engage the corresponding third cams 53 and 54. In association with the fact that one of the two atmosphere release valves 80 and 81 corresponds to the cap member 31 at the one end and the other one corresponds to the remaining cap members 31 as described above, the one third cam 53 of the two third cams 53 and 54 corresponds to the cap member 31 at the one end, and the other third cam 54 corresponds to the remaining cap members 31. The other end portions 80*b* and 81*b* in the longitudinal direction of the respective atmosphere release valves 80 and 81 have valve element supporting portions 80*c* and 81*c* projecting upward as shown in FIG. 7 and FIG. 8. Respective valve elements 80*d* and 81*d* are supported by the respective valve element supporting portions 80*c* and 81*c* in a state of covering over the valve element supporting portions 80*c* and 81*c*.

Valve seats with respect to the valve elements 80*d* and 81*d* are lip portions 82*a* and 83*a* provided on valve seat forming members 82 and 83 as shown in FIG. 7 and FIG. 8. The lip portions 82*a* and 83*a* are substantially cylindrical portions projecting toward the one end side of the direction corresponding to the direction of transport of the recording medium P as shown in FIG. 7 and FIG. 8, and come into contact with the valve elements 80*d* and 81*d* at distal end portions 82*c* and 83*c* thereof. The tube supporting portions 82*b* and 83*b* support terminal ends of the connecting tubes (not shown) connected to the cap members 31 by fitting the terminal ends of the connecting tubes. In this embodiment, the one tube supporting portion 82*b* supports the terminal end of the connecting tube connected to the cap member 31 at the one end. The other the other tube supporting portion 83*b* supports the terminal end of the connecting tube which is a unified portion of the connecting tube which is branched at a distal end and connected to the respective cap members 31.

As shown in FIG. 7 and FIG. 8, internal spaces of the lip portions 82*a* and 83*a* and internal spaces of the tube supporting portions 82*b* and 83*b* are communicated via communication holes 82*d* and 83*d*. Therefore, the internal spaces of the lip portions 82*a* and 83*a* are in communication with the internal spaces of the cap members 31 via the connecting tubes supported by the tube supporting portions 82*b* and 83*b*. Then, when the valve elements 80*d* and 81*d* and the distal end portions 82*c* and 83*c* of the lip portions 82*a* and 83*a* come into contact with each other, distal end openings of the lip portions 82*a* and 83*a* are closed, and hence terminal end openings of the connecting tubes are closed. In contrast, when the valve elements 80*d* and 81*d* move away from the distal end portions 82*c* and 83*c* of the lip portions 82*a* and 83*a*, the distal end openings of the lip portions 82*a* and 83*a* are released, and hence the internal spaces of the connecting tubes communicate with the atmosphere.

The respective atmosphere release valves 80 and 81 are supported so as to be pivotable about pivotal shafts 80*e* and 81*e*. Also, the atmosphere release valves 80 and 81 are urged in the direction in which the valve elements 80*d* and 81*d* pivot to come into contact with the distal end portions 82*c* and 83*c* of the lip portions 82*a* and 83*a* by an urging member, not shown.

Figure 10:
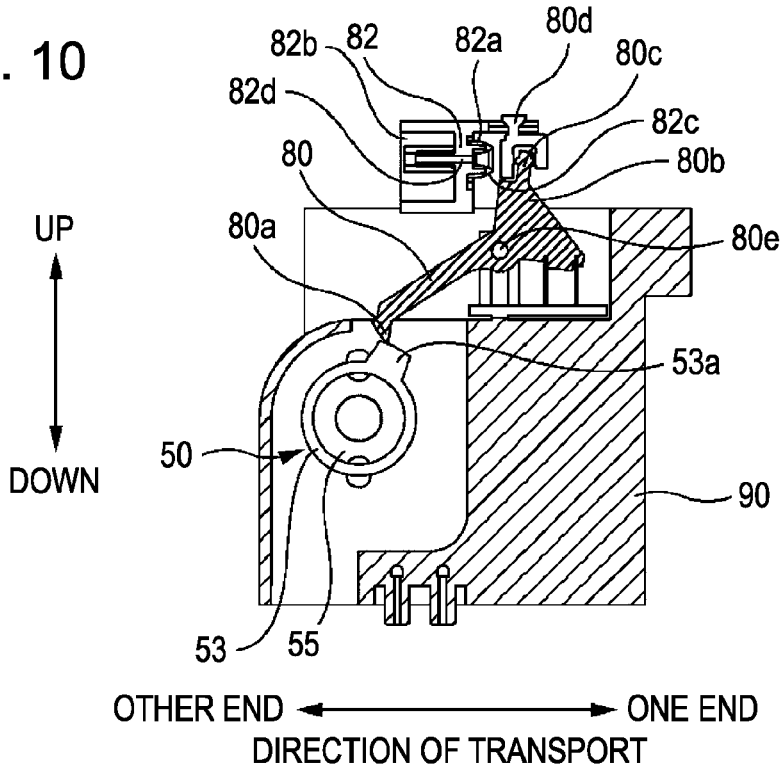
FIG. 10 is a drawing showing a state in which an atmosphere release valve 80 is in an opened state.
Figure 11:
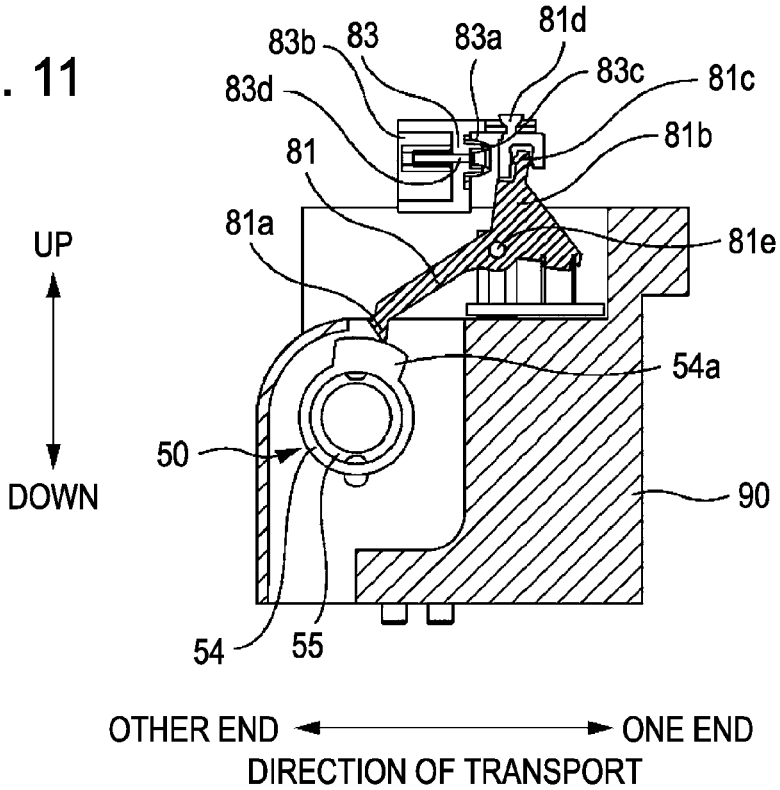
FIG. 11 is a drawing showing a state in which an atmosphere release valve 81 is in an opened state.

Subsequently, opening and closing of the atmosphere release valves 80 and 81 configured as described above will be described. While the engaged portions 80*a* and 81*a* of the atmosphere release valves 80 and 81 are not in engagement with the engaging portions 53*a* and 54*a* of the corresponding third cams 53 and 54, since the atmosphere release valves 80 and 81 are urged by the urging member as described above, the valve elements 80*d* and 81*d* of the atmosphere release valves 80 and 81 are continuously in contact with the distal end portions 82*c* and 83*c* of the lip portions 82*a* and 83*a* as shown in FIG. 7 and FIG. 8. In other words, at this time, the respective atmosphere release valves 80 and 81 are in a closed sate. In contrast, when the corresponding third cams 53 and 54 rotate in a state in which the engaged portions 80*a* and 81*a* of the atmosphere release valves 80 and 81 and the engaging portions 53*a* and 54*a* of the corresponding third cams 53 and 54 are in engagement, the atmosphere release valves 80 and 81 pivot in such a manner that the valve elements 80*d* and 81*d* moves away from the distal end portions 82*c* and 83*c* of the lip portions 82*a* and 83*a* about the pivotal shafts 80*e* and 81*e*. In other words, the engaging portions 53*a* and 54*a* of the third cams 53 and 54 press the engaged portions 80*a* and 81*a* of the corresponding atmosphere release valves 80 and 81 in the direction of rotation of the third cams 53 and 54 against an urging force of the urging member acting on the corresponding atmosphere release valves 80 and 81. Accordingly, as shown in FIG. 10 and FIG. 11, the valve elements 80*d* and 81*d* of the atmosphere release valves 80 and 81 move away from the distal end portions 82*c* and 83*c* of the lip portions 82*a* and 83*a*, and the atmosphere release valves 80 and 81 are brought into an opened sate. FIG. 10 and FIG. 11 show a state in which the atmosphere release valves 80 and 81 are respectively brought into the opened state, and correspond respectively to FIG. 7 and FIG. 8.

Then, when the cap members 31 are in contact with the nozzle surface 22, if the atmosphere release valves 80 and 81 corresponding to the cap members 31 are in the closed state, the terminal end openings of the connecting tubes connected to the cap members 31 are closed, so that the internal spaces (waste ink receiving spaces) of the cap members 31 are isolated from the atmosphere. In contrast, when the cap members 31 are in contact with the nozzle surface 22, if the atmosphere release valves 80 and 81 corresponding to the cap members 31 are in the opened state, the internal spaces of the connecting tubes connected to the cap members 31 are brought into communication with the atmosphere, so that the internal spaces of the cap members 31 are brought into the atmosphere release state.

With the maintenance unit 24 in the configuration as described above, the cleaning operation and operations in association with the cleaning operation are performed. As described above, the plurality of cap members 31 are provided corresponding respectively to the plurality of nozzle rows formed on the nozzle surface 22 of the head 21 in this embodiment. Also, the suction pumps 60 and the atmosphere release valves 80 and 81 are separated into the one corresponding to the cap member 31 at the one end and the one corresponding to the remaining cap members 31. Furthermore, in this embodiment, a timing to open the atmosphere release valves 80 and 81 while the suction pumps 60 are in operation is changed between the atmosphere release valves 80 and 81.

More specifically, the atmosphere release valve 80 corresponding to the cap member 31 at the one end is closed and the atmosphere release valve 81 corresponding to the remaining cap members 31 is opened at a certain period while the two respective suction pumps 60 are in operation in a state in which the cap unit 30 is positioned at the sealing position. Therefore, in the above-described certain period, the suction pump 60 corresponding to the cap member 31 at the one end brings the internal space (that is, the waste ink receiving space) of the cap member 31 at the one end into the negative pressure state, and performs an operation to suck ink in the respective nozzles Nz sealed by the cap member 31 at the one end (closed suction). In contrast, in the certain period as described above, since the internal spaces of the remaining cap members 31 are in the atmosphere release state, the suction pump 60 corresponding to the remaining cap members 31 performs an opened suction.

Then, in this embodiment, only the cap member 31 at the one end and the suction pump 60 corresponding to the cap member 31 at the one end perform the closed suction for the cleaning operation. In other words, only one nozzle row closed by the cap member 31 at the one end from among the plurality of nozzle rows formed on the nozzle surface 22 of the head 21 corresponds to the object of the cleaning operation. That is, when performing the cleaning operation, the one nozzle row as the object of the cleaning operation is positioned above the cap member 31 at the one end in the direction of movement of the head 21. On the other hand, when performing the flushing operation, described later, the plurality of nozzle rows formed on the nozzle surface 22 are respectively positioned above the corresponding cap members 31 (in other words, the respective nozzle rows and the respective cap members 31 are positioned in pairs). An operation of the maintenance unit 24 will be described again in detail later.

Slider Drive Mechanism 100

Figure 13:
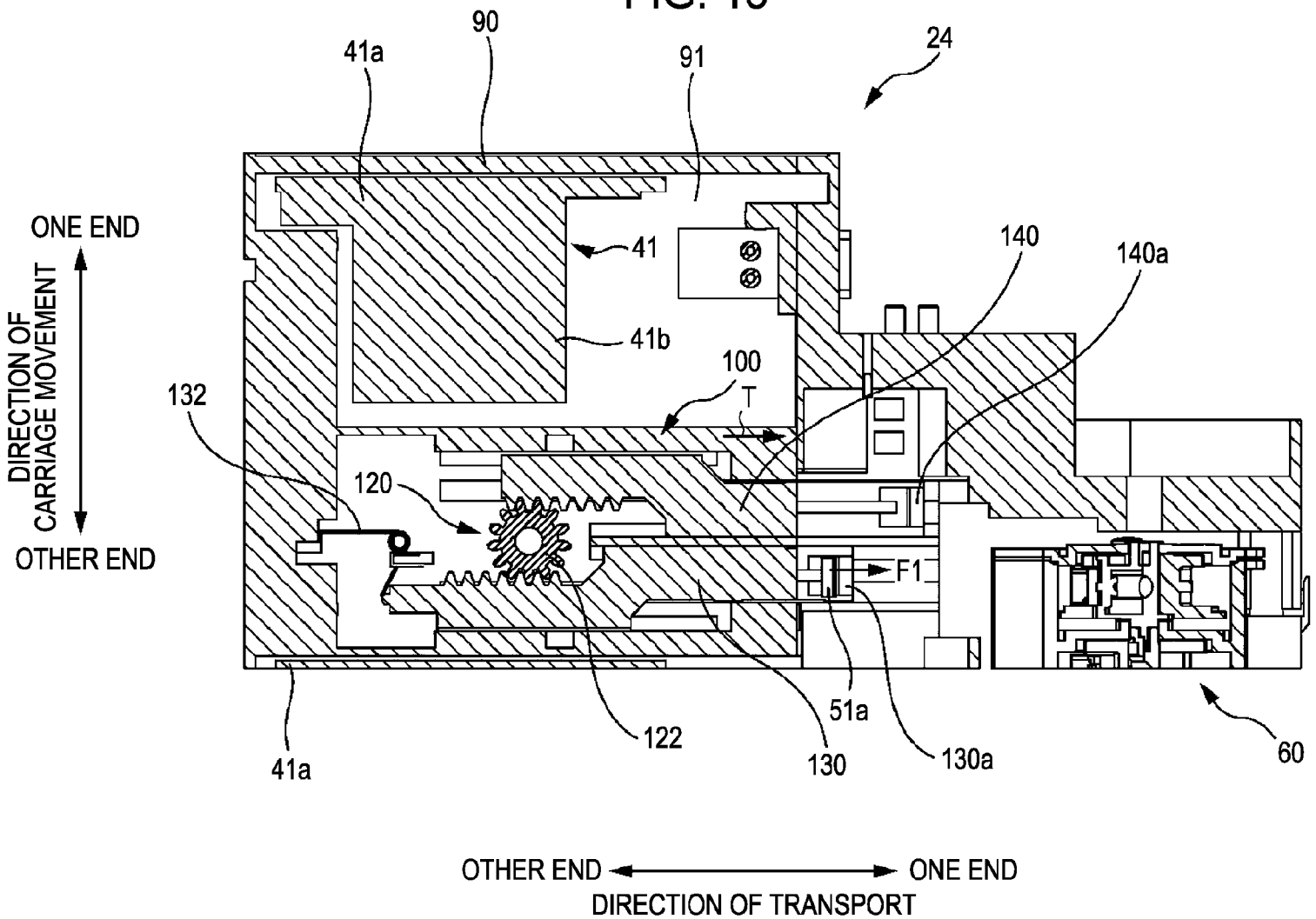
FIG. 13 is a second explanatory drawing showing the configuration of the slider drive mechanism 100.

Referring now to FIG. 5 and FIG. 6, which are already described above, and FIG. 12 and FIG. 13, a configuration of the slider drive mechanism 100 will be described. FIG. 12 and FIG. 13 are explanatory drawings showing the configuration of the slider drive mechanism 100. FIG. 12 is a cross section taken along the line XII-XII in FIG. 6, and FIG. 13 is a cross section taken along the line XIII-XIII in FIG. 6, respectively. In FIG. 12 and FIG. 13, a direction corresponding to the direction of movement of the carriage 16 and a direction corresponding to the direction of transport of the recording medium P are shown by arrows, respectively. For the convenience of representation in the drawing, the cross section taken along the line XIII-XIII in FIG. 13 includes cross sections at different positions in the vertical direction between the cross sections on the one end side and the other end side in the direction corresponding to the direction of transport (see FIG. 6).

The slider drive mechanism 100 performs the first movement for moving the slider 41 rectilinearly in the one direction and the second movement for moving the slider 41 rectilinearly in the other direction by the drive force from the drive motor 70 transmitted by the cam unit 50 as described above. In other words, the slider drive mechanism 100 is configured to transform the rotational movement of the drive motor 70 in the normal direction (more specifically, the rotational movement of the drive shaft 71) to the rectilinear movement of the slider 41 in cooperation with the cam unit 50.

The slider drive mechanism 100 includes a slider rack 110 as a first rack, a composite gear 120, and the elevating rack 130 and the lowering rack 140 as a pair of second racks as shown in FIG. 5, FIG. 6, FIG. 12, and FIG. 13.

The slider rack 110 is a rack projecting from an inner wall surface of the vertical portion 41*a* (the vertical portion 41*a* at the other end side in the direction corresponding to the direction of movement of the carriage 16) of the slider 41 as shown in FIG. 12. The slider rack 110 is integrally molded with the slider 41, and is fixed to the slider 41. Therefore, the slider rack 110 is interlocked with the slider 41. In other words, when the slider rack 110 is moved, the slider 41 is moved integrally with the slider rack 110 in the direction of movement of the slider rack 110. Respective teeth of the slider rack 110 are arranged in the direction corresponding to the direction of transport of the recording medium P, that is, along the direction of the rectilinear movement of the slider 41.

The composite gear 120 is positioned below the horizontal portion 41*b* of the slider 41 in the interior of the casing 90, and includes a large gear 121 shown in FIG. 12 and a small gear 122 shown in FIG. 13. The composite gear 120 is mounted in the cap unit chamber 91 in a state in which the large gear 121 is positioned above the small gear 122, and a revolving shaft extend along the vertical direction, and is able to rotate about the revolving shaft in the normal direction and the reverse direction. The position of arrangement of the composite gear 120 in the cap unit chamber 91 is a position at which the large gear 121 engages the slider rack 110.

Then, the composite gear 120 moves the slider rack 110 rectilinearly in the one direction when the large gear 121 rotates in the normal direction in a state of engaging the slider rack 110. Consequently, the slider 41 to which the slider rack 110 is fixed moves rectilinearly in the one direction. In contrast, the composite gear 120 moves the slider rack 110 rectilinearly in the other direction when the large gear 121 rotates in the reverse direction in the state of engaging the slider rack 110. Consequently, the slider 41 moves rectilinearly in the other direction. In other words, in this embodiment, a pinion-rack mechanism is employed as a mechanism to move the slider 41 rectilinearly.

The elevating rack 130 and the lowering rack 140 are both formed of plate-shaped members, and are racks being positioned on a bottom surface of the cap unit chamber 91 and engaging the small gear 122 in an opposed state, and the lowering rack 140 is arranged on one end side and the elevating rack 130 is arranged on the other end side in the direction corresponding to the direction of movement of the carriage 16. The elevating rack 130 and the lowering rack 140 are each formed with teeth for engaging the small gear 122 on the other end portion in a direction corresponding to the direction of transport of the recording medium P as shown in FIG. 13. The elevating rack 130 and the lowering rack 140 are both attached in the interior of the cap unit chamber 91 so as to be movable rectilinearly in the direction corresponding to the direction of transport (that is, in the direction of rectilinear movement of the slider 41).

Then, when the elevating rack 130 is moved rectilinearly in the one direction (the direction from the other end to the one end in the direction corresponding to the direction of transport of the recording medium P, and is the direction indicated by a sign T in FIG. 13) in a state of engaging the small gear 122, the composite gear 120 including the small gear 122 rotates in the normal direction. At this time, the lowering rack 140 engaging the small gear 122 at a position opposing the elevating rack 130 moves rectilinearly in the other direction (the direction opposite from the direction of rectilinear movement of the elevating rack 130). In the same manner, when the lowering rack 140 is moved rectilinearly in the one direction in a state of engaging the small gear 122, the composite gear 120 including the small gear 122 rotates in the reverse direction, so that the elevating rack 130 is moved rectilinearly in the other direction (the direction opposite from the direction of the rectilinear movement of the lowering rack 140).

Provided at one end portion of the elevating rack 130 in the direction corresponding to the direction of transport is the engaged portion 130*a* which engages the engaging portion 51*a* of the first cam 51 in a state of being projected from an upper surface of the elevating rack 130 substantially in the vertical direction. Then, when the first cam 51 rotates in a state in which the engaging portion 51*a* of the first cam 51 engages the engaged portion 130*a* of the elevating rack 130, as shown in FIG. 13, a pressing force F1 that the engaging portion 51*a* of the first cam 51 presses the elevating rack 130 in the one direction is generated. The elevating rack 130 is moved rectilinearly in the one direction by the pressing force F1.

Figure 14:
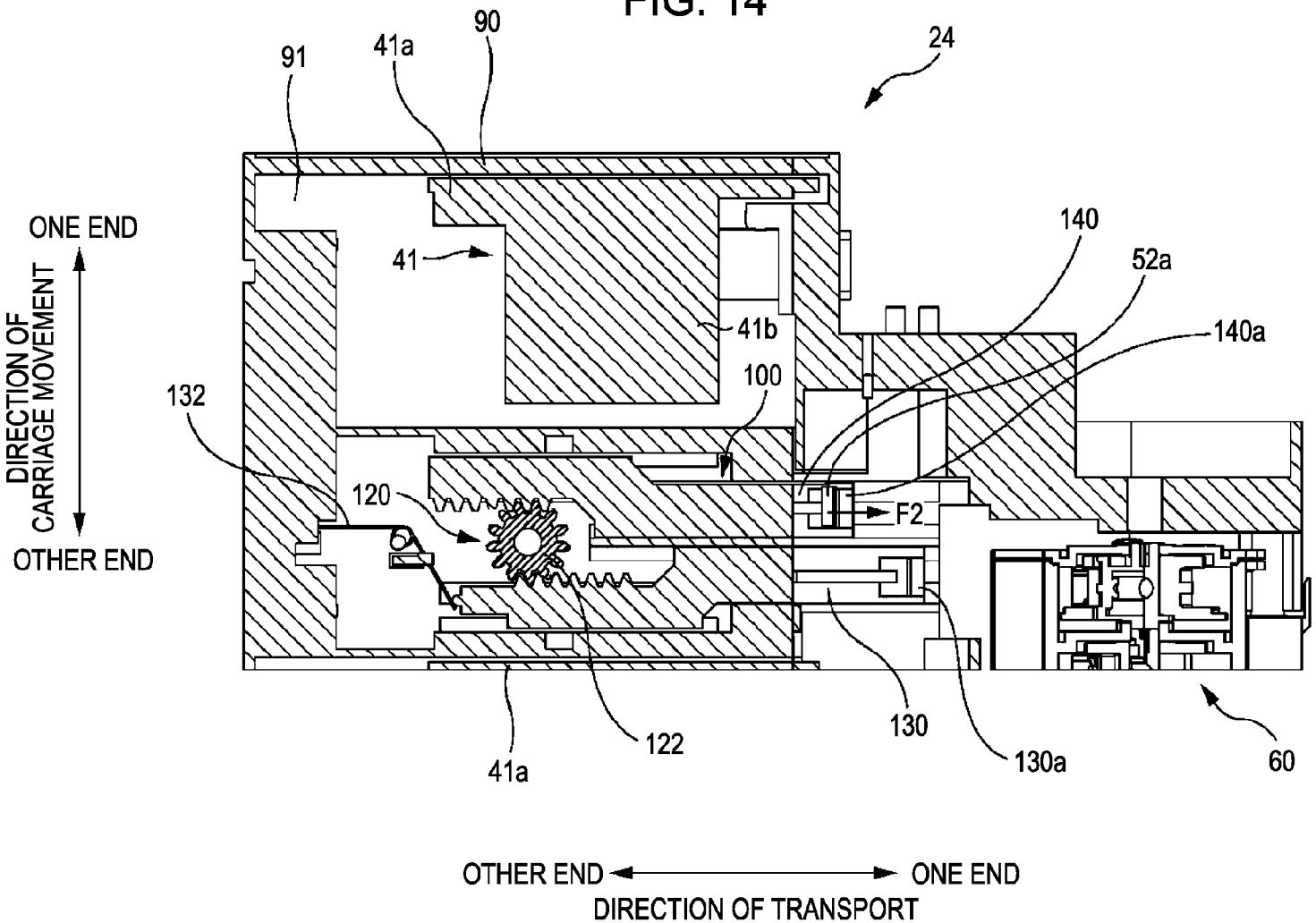
FIG. 14 is a drawing showing a state in which an engaging portion 52*a* of a second cam 52 engages an engaged portion 140*a* of a lowering rack 140.

In the same manner, provided at one end portion of the lowering rack 140 in the direction corresponding to the direction of transport is the engaged portion 140*a* which engages the engaging portion 52*a* of the second cam 52 in a state of being projected from an upper end surface of the lowering rack 140 substantially in the vertical direction. Then, when the second cam 52 rotates in a state in which the engaging portion 52*a* thereof engages the engaged portion 140*a* of the lowering rack 140, as shown in FIG. 14, a pressing force F2 that the engaging portion 52*a* of the second cam 52 presses the lowering rack 140 in the one direction is generated. The lowering rack 140 is moved rectilinearly in the one direction by the pressing force F2. FIG. 14 is a drawing showing the state in which the engaging portion 52*a* of the second cam 52 engages the engaged portion 140*a* of the lowering rack 140, and corresponds to FIG. 13.

The slider drive mechanism 100 having the configuration as described above receives the drive force from the drive motor 70 via the cam unit 50, which rotates in the direction indicated by the arrow R in FIG. 5 in association with the rotation of the drive motor 70 in the normal direction, and performs the first movement and the second movement as described above by the drive force.

Figure 15:
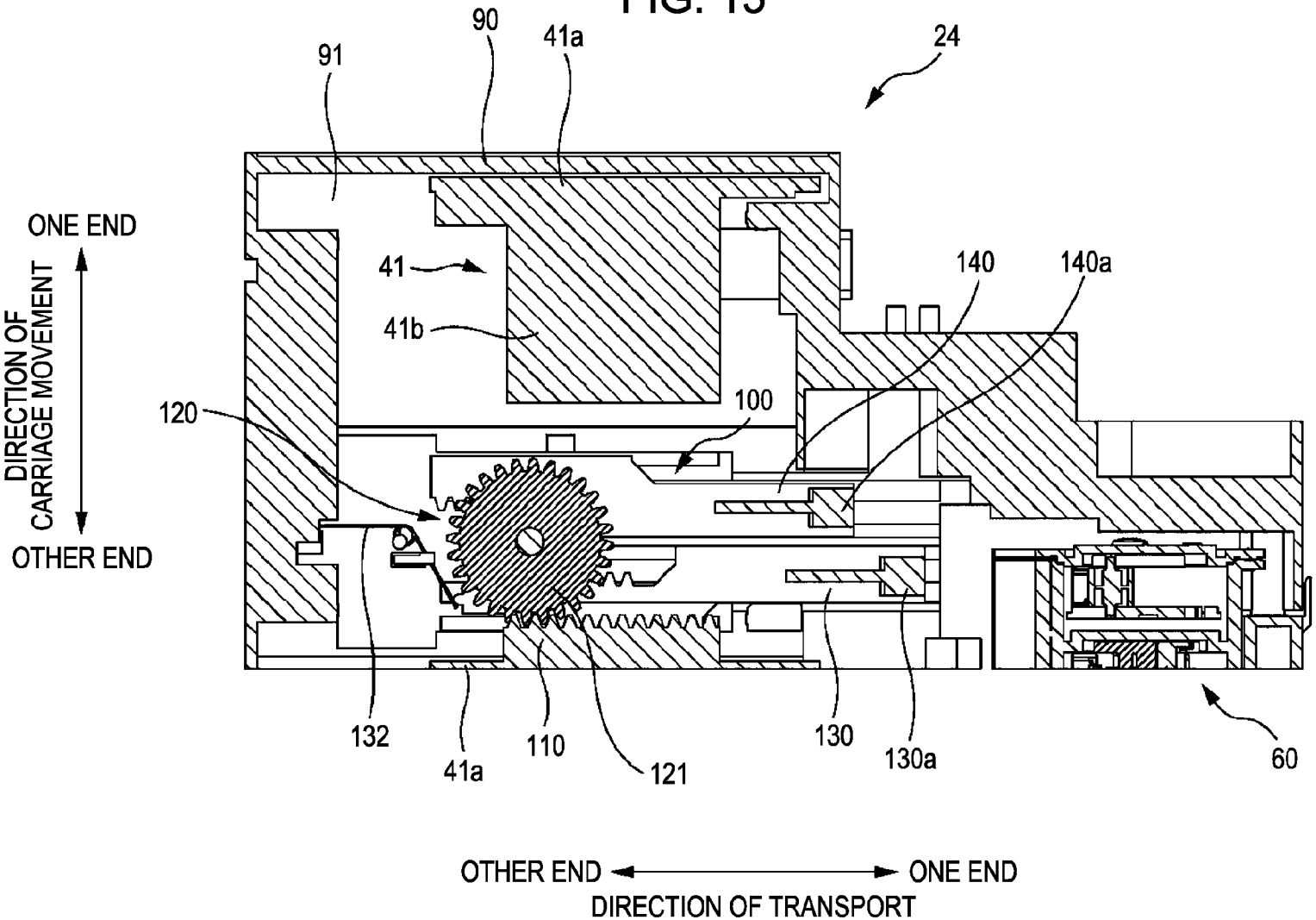
FIG. 15 is a drawing showing a state in which an elevating rack 130 reaches a terminal end of a rectilinear movement in one direction.

More specifically, when the first cam 51 reaches a position where the engaging portion 51*a* of the first cam 51 engages the engaged portion 130*a* of the elevating rack 130 in the direction of rotation by the rotation of the cam unit 50, and then the cam unit 50 further continues to rotate, the first cam 51 rotates in the state in which the engaging portion 51*a* of the first cam 51 engages the engaged portion 130*a* of the elevating rack 130, so that the elevating rack 130 is moved rectilinearly in the one direction. Accordingly, the composite gear 120 rotates in the normal direction. The composite gear 120 rotates in the normal direction and moves the lowering rack 140 which engages the small gear 122 on the opposite side from the elevating rack 130 rectilinearly in the other direction, and moves the slider rack 110 which engages the large gear 121 rectilinearly in the one direction integrally with the slider 41. A series of operations as described above corresponds to the first movement of the slider drive mechanism 100. Then, at a time point when the elevating rack 130 reaches the terminal end of the rectilinear movement in the one direction (the position of the elevating rack 130 shown in FIG. 15), the first movement is completed, and the elevation of the cap unit 30 by the slider 41 is also ended (brought into the state in which the cap unit 30 is positioned at the sealing position). FIG. 15 is a drawing showing a state in which the elevating rack 130 reaches the terminal end of the rectilinear movement in the one direction, which corresponds to FIG. 12.

In contrast, when the second cam 52 reaches a position where the engaging portion 52*a* of the second cam 52 engages the engaged portion 140*a* of the lowering rack 140 in the direction of rotation thereof by the rotation of the cam unit 50, and then the cam unit 50 further continues to rotate, the second cam 52 rotates in the state in which the engaging portion 52*a* of the second cam 52 engages the engaged portion 140*a* of the lowering rack 140, so that the lowering rack 140 is moved rectilinearly in the one direction. Accordingly, the composite gear 120 rotates in the reverse direction. The composite gear 120 rotates in the reverse direction and moves the elevating rack 130 which engages the small gear 122 on the opposite side from the lowering rack 140 rectilinearly in the other direction, and moves the slider rack 110 which engages the large gear 121 rectilinearly in the other direction integrally with the slider 41. The series of operations as described above corresponds to the second movement of the slider drive mechanism 100. Then, at a time point when the lowering rack 140 reaches the terminal end of the rectilinear movement in the one direction (the position of the lowering rack 140 shown in FIG. 12), the second movement is completed, and the lowering of the cap unit 30 by the slider 41 is also ended (brought into the state in which the cap unit 30 is positioned at the off position).

In this embodiment, as shown in FIG. 13 and FIG. 14, a coil spring 132 is arranged in the interior of the cap unit chamber 91. The coil spring 132 urges the elevating rack 130 in the one end side of the direction corresponding to the direction of transport of the recording medium P in a state in which one end portion thereof is in contact with the other end of the same direction. Therefore, in the second movement in which the elevating rack 130 is moved rectilinearly in the other direction (in other words, the lowering rack 140 is moved rectilinearly in the one direction), the elevating rack 130 moves rectilinearly in the other direction against the urging force. When the cap unit 30 is moved downward by the slider drive mechanism 100 causing the slider 41 to move in the other direction by the urging force of the coil spring 132, abrupt lowering of the cap unit 30 is prevented. Accordingly, an impact applied to the cap unit 30 when the cap unit 30 is lowered to the off position may be alleviated.

Operation of Maintenance Unit 24

Figure 16:
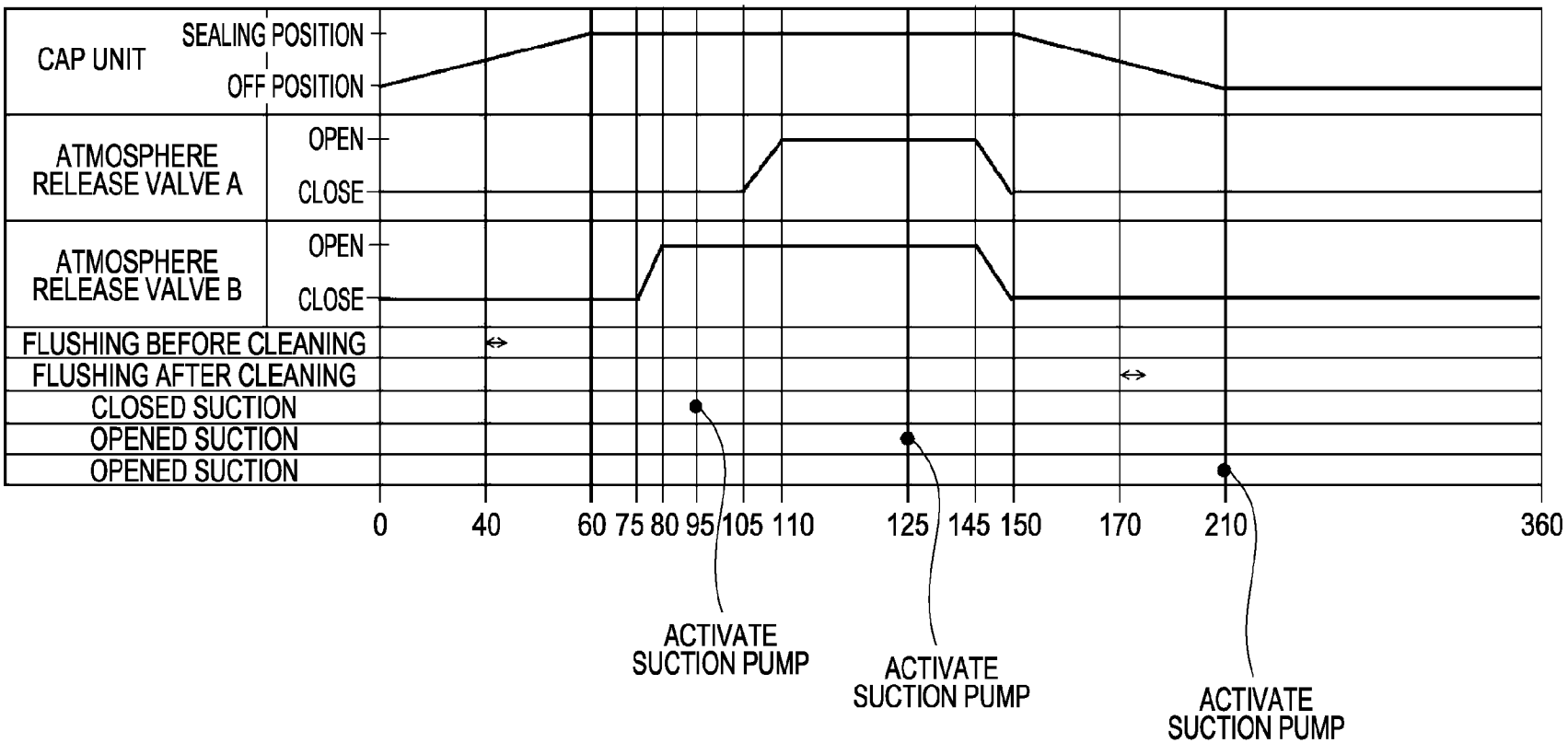
FIG. 16 is a timing diagrammatic drawing relating to an operation of the maintenance unit 24.

Referring now to FIG. 16, the operation of the maintenance unit 24 such as the vertical movement of the cap unit 30 or an opening and closing operation of the respective atmosphere release valves 80 and 81 will be described. FIG. 16 is a timing diagrammatic drawing relating to the operation of the maintenance unit 24. The lateral axis of the same diagrammatic drawing indicates the amount of rotation of the cam unit 50 from a reference time point (angle of rotation), and in the following description, a time point when the first cam 51 starts to engage the elevating rack 130 is defined as the reference time point (that is, a time point when the angle of rotation is 0 degree).

Figure 17:
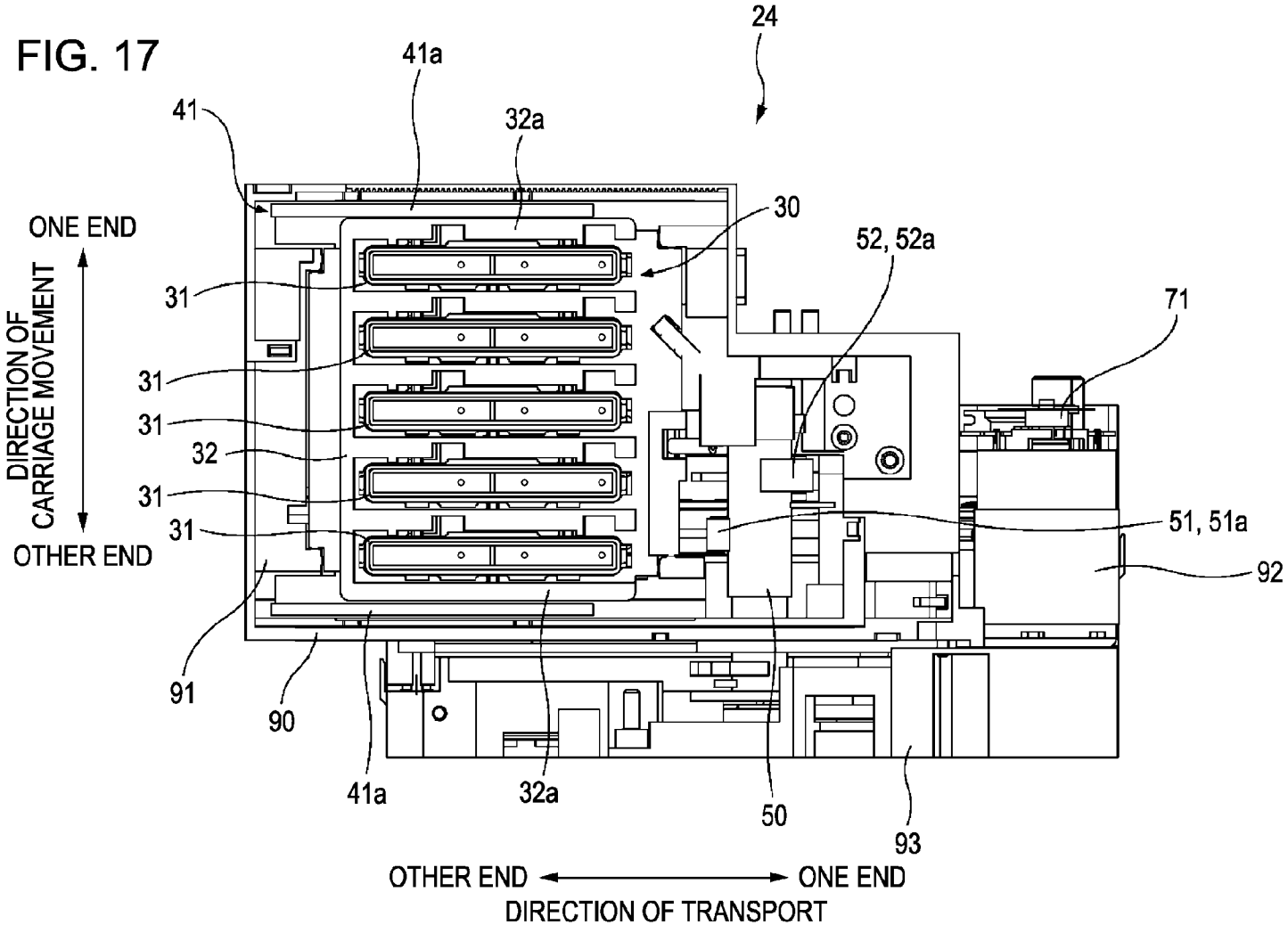
FIG. 17 is a drawing showing a state in which the maintenance unit 24 is ready for the cleaning operation.
Figure 18A:
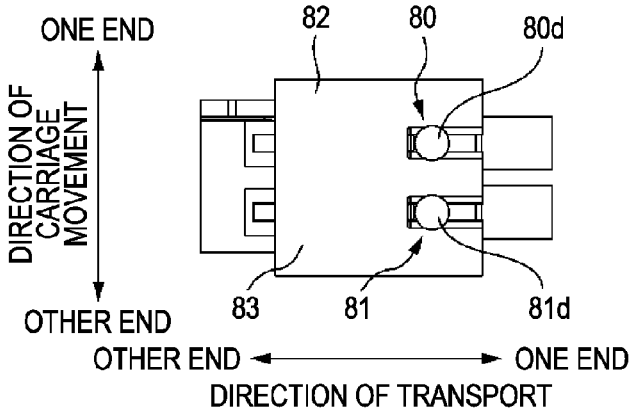
FIG. 18A is a drawing showing a state in which the two atmosphere release valves 80 and 81 are in a closed state.

When the maintenance unit 24 performs the cleaning operation as described above, first of all, the head 21 moves to the home position in association with the movement of the carriage 16. At this time, the maintenance unit 24 is a state shown in FIG. 17 when viewed from above, and in this state, the cap unit 30 is positioned at the off position in the vertical direction. FIG. 17 is a drawing showing a state in which the maintenance unit 24 is ready for the cleaning operation. At this time, as shown in FIG. 18A, the two atmosphere release valves 80 and 81 are both in the closed state. FIG. 18A is a drawing when the two atmosphere release valves 80 and 81 are in the closed sate, and is an enlarged drawing showing the periphery of the atmosphere release valves 80 and 81 in FIG. 4.

When the head 21 reaches the home position, the respective nozzle rows formed on the nozzle surface 22 are positioned right above the opening of the corresponding cap members 31 (for example, the nozzle row positioned at the extremity at one end side in the direction of movement of the head 21 is positioned right above the opening of the cap member 31 at the one end). In this state, the drive motor 70 rotates in the normal direction, and the cam unit 50 rotates in association with the rotation of the drive motor 70. At a time point when the cam unit 50 starts to rotate (more specifically, it is a time point when the cam unit 50 starts to rotate firstly after the head 21 is positioned at the home position, and corresponds to the reference time point described above), the engaging portion 51*a* of the first cam 51 engages the engaged portion 130*a* of the elevating rack 130.

By the rotation of the cam unit 50, the first cam 51 rotates in the state in which the engaging portion 51*a* thereof engages the engaged portion 130*a* of the elevating rack 130. Accordingly, the pressing force F1 that the engaging portion 51*a* of the first cam 51 presses the elevating rack 130 in the one direction is generated. Consequently, the slider drive mechanism 100 performs the first movement, and the slider 41 moves rectilinearly in the one direction by this first movement. Consequently, the cap unit 30 moves upward toward the sealing position as shown in FIG. 16.

In this embodiment, while the engaging portion 51*a* of the first cam 51 rotates while engaging the engaged portion 130*a* of the elevating rack 130, the engaging state between the engaging portion 52*a* of the second cam 52 and the engaged portion 140*a* of the lowering rack 140 is released. In other words, while the first cam 51 engages the elevating rack 130, the second cam 52 is positioned at a position away from the lowering rack 140 in the direction of rotation. In this configuration, when the first cam 51 rotates in the state of engaging the elevating rack 130, that is, when the slider drive mechanism 100 performs the first movement, the slider drive mechanism 100 performs the first movement adequately without being interfered with the second cam 52. The configuration as described above, may be realized by adjusting the shapes of the first cam 51 and the second cam 52 (more specifically, the shapes of the engaging portions 51*a* and 52*a*), the relative positional relationship between the position of the first cam 51 and the position of the second cam 52 viewed from the cam shaft 55, and the shapes or the position of the engaged portions 130*a* and 140*a* of the elevating rack 130 and the lowering rack 140.

Then, when the cam unit 50 rotates by about 40 degrees from the reference time point, as shown in FIG. 16, an operation to forcedly eject ink from the nozzles Nz of the head 21, that is, the flushing operation is performed. The flushing operation is an operation to drive the piezoelectric elements provided for the respective nozzles to forcedly eject ink in the nozzles Nz from the nozzles Nz. The flushing operation is performed in association with the above-described cleaning operation for the purpose of discharging ink increased in viscosity in the vicinity of the openings of the nozzles Nz and putting meniscuses formed at the openings of the nozzles Nz in order. The waste ink generated by the flushing operation is received in the internal spaces of the cap members 31 corresponding to the nozzles Nz from which the waste ink is ejected (the cap members 31 positioned right below the respective nozzles Nz). Since the cap unit 30 is in the course of elevating when the flashing operation is performed, the respective cap members 31 receive the waste ink generated by the flushing operation in the internal spaces thereof while elevating.

By the further rotation of the cam unit 50, the first cam 51 further rotates in the state in which the engaging portion 51*a* thereof engages the engaged portion 130*a* of the elevating rack 130, the slider drive mechanism 100 continues to perform the first movement and the slider 41 continues to move further rectilinearly in the one direction. Accordingly, the cap unit 30 is continued to elevate further toward the sealing position. During this period, the above-described flushing operation is ended, and the head 21 is moved to a position where one of the nozzle rows which is an object of the cleaning operation is positioned right above the cap member 31 at the one end.

Figure 19:
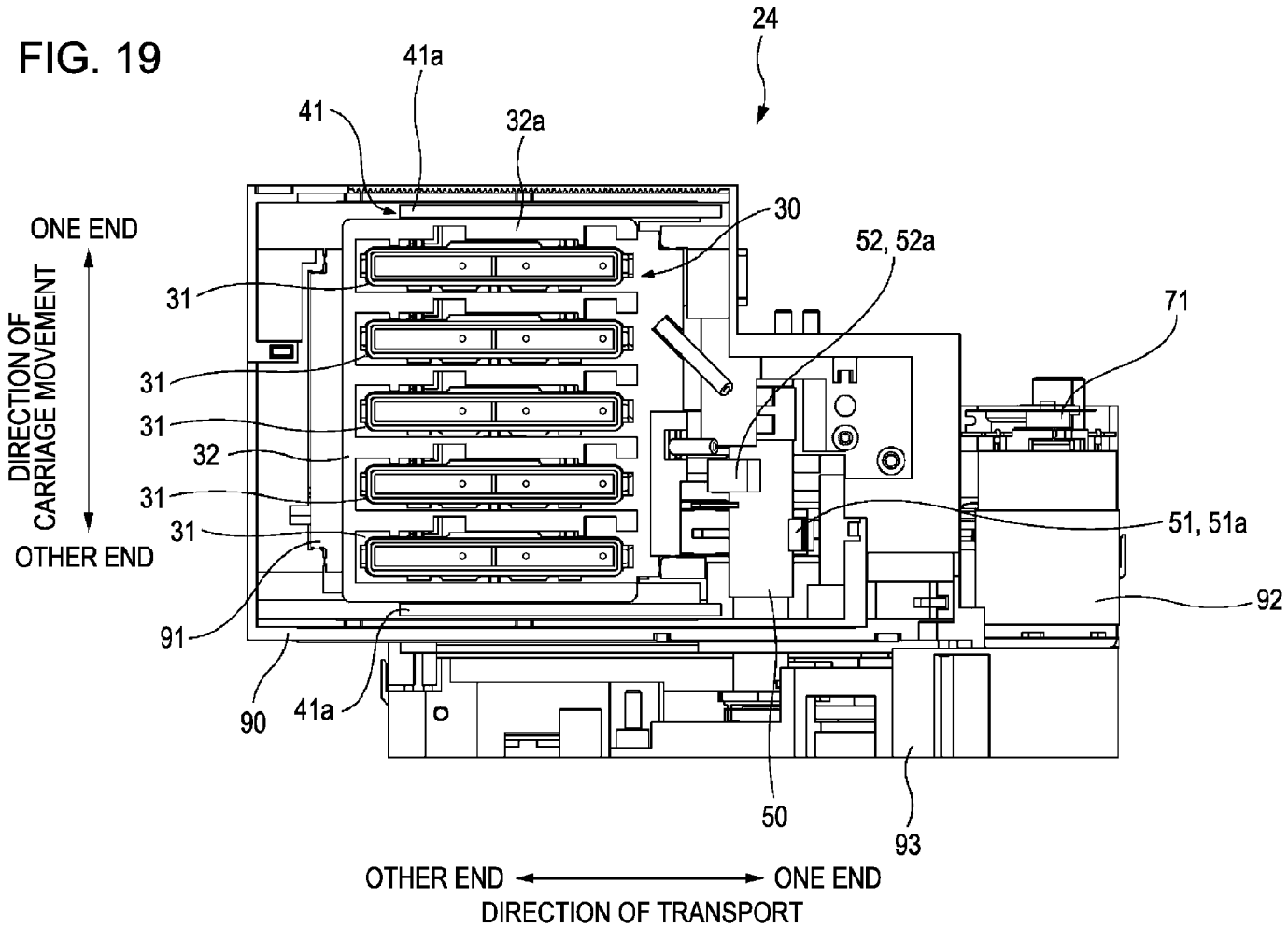
FIG. 19 is a drawing showing a state in which the maintenance unit 24 is finished with a first movement.

Then, at a time point when the cam unit 50 rotates by about 60 degrees from the reference time point, as shown in FIG. 16, the cap unit 30 reaches the sealing position and the first movement by the slider drive mechanism 100 is ended (that is, the rectilinear operation of the slider 41 in the one direction is ended), and the maintenance unit 24 assumes a state shown in FIG. 19 when viewed from above. FIG. 19 is a drawing showing a state of the maintenance unit 24 after the first movement is ended.

As a result of reaching of the cap unit 30 to the sealing position, the cap member 31 at the one end (more specifically, the seal member 31*a* of the cap member 31 at the one end) comes into contact with the nozzle surface 22 so as to surround one of the nozzle rows as the object of the cleaning operation. Then, the cap unit 50 rotates until the engaging state between the engaging portion 51*a* of the first cam 51 and the engaged portion 130*a* of the elevating rack 130 is released. More specifically, the cam unit 50 rotates until both the engaging state between the engaging portion 51*a* of the first cam 51 and the engaged portion 130*a* of the elevating rack 130 and the engaging state between the engaging portion 52*a* of the second cam 52 and the engaged portion 140*a* of the lowering rack 140 are brought into a released state.

When the cam unit 50 rotates by about 75 degrees from the reference time point, as shown in FIG. 16, the engaged portion 81*a* of the one atmosphere release valve 81 (atmosphere release valve B in FIG. 16) of the two atmosphere release valves 80 and 81 and the engaging portion 54*a* of the third cam 54 corresponding to the one atmosphere release valve 81 of the two third cams 53 and 54 engage. Here, the one atmosphere release valve 81 corresponds to the cap members 31 other than the cap member 31 at the one end (that is, the remaining cap members 31). In other words, the one atmosphere release valve 81 corresponds to the cap members 31 which seal the nozzle rows other than the nozzle row as the object of the cleaning operation.

Figure 18B:
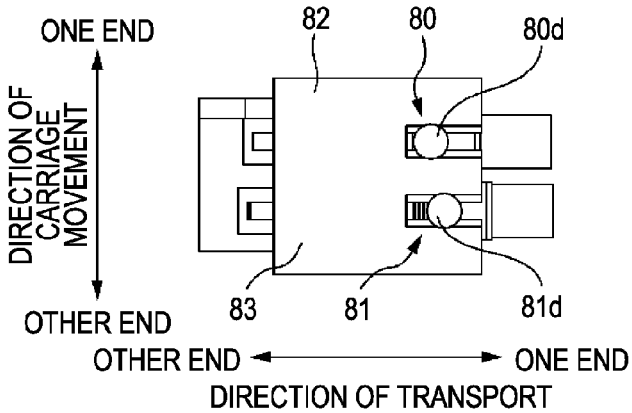
FIG. 18B is a drawing showing a state in which the one atmosphere release valve 81 is in the opened state.

By the further rotation of the cam unit 50, the third cam 54 corresponding to the one atmosphere release valve 81 rotates in a state in which the engaging portion 54*a* engages the engaged portion 81*a* of the one atmosphere release valve 81, so that the one atmosphere release valve 81 gradually opens. Then, as shown in FIG. 16, at a time point when the cam unit 50 rotates by about 80 degrees from the reference time point, the one atmosphere release valve 81 assumes a completely opened state. In contrast, at this time, the other atmosphere release valve 80 (that is, the atmosphere release valve 80 corresponding to the cap member 31 at the one end) is still in the closed state as shown in FIG. 18B. In other words, while the engaging portion 54*a* of the third cam 54 corresponding to the one atmosphere release valve 81 engages the engaged portion 81*a* of the atmosphere release valve 81, an engaging state between the engaging portion 53*a* of the third cam 53 corresponding to the other atmosphere release valve 80 and the engaged portion 80*a* of the atmosphere release valve 80 is released. In other words, in this embodiment, the atmosphere release valve 81 corresponding to the remaining cap members 31 is opened prior to the atmosphere release valve 80 corresponding to the cap member 31 at the one end. FIG. 18B is a drawing showing a state in which the one atmosphere release valve 81 is brought into the opened state, and a state in which the one atmosphere release valve 81 is in the opened state while the other atmosphere release valve 80 is in the closed state.

In this embodiment, while the engaging portion 54*a* of the third cam 54 corresponding to the one atmosphere release valve 81 engages the engaged portion 81*a* of the one atmosphere release valve 81, the engaging state between the engaging portion 51*a* of the first cam 51 and the engaged portion 130*a* of the elevating rack 130, and the engaging state between the engaging portion 52*a* of the second cam 52 and the engaged portion 140*a* of the lowering rack 140 are both released. In other words, while the first cam 51 is positioned at a position apart from the elevating rack 130 in the direction of rotation thereof and the second cam 52 is positioned at the position apart from the lowering rack 140 in the direction of rotation thereof, the third cam 54 corresponding to the one atmosphere release valve 81 engages the one atmosphere release valve 81. In this configuration, a timing when the third cam 54 corresponding to the one atmosphere release valve 81 rotates while engaging the one atmosphere release valve 81 is different from a timing when the first cam 51 rotates while engaging the elevating rack 130 and a timing when the second cam 52 rotates while engaging the lowering rack 140. Consequently, a load (torque load) applied to the cam shaft 55 is reduced in comparison with a case in which these timings are overlapped with each other.

The configuration in which the respective timings are shifted from each other is realized by adjusting the shapes of the first cam 51, the second cam 52, and the third cam 54 corresponding to the one atmosphere release valve 81, the relative positional relationship among the respective cams when viewed from the cam shaft 55, and the shapes or the positions of the engaged portions which engage the engaging portions 51a, 52*a*, and 54*a* (that is, the respective engaged portions 130*a*, 140*a*, and 81*a* of the elevating rack 130, the lowering rack 140, and the one atmosphere release valve 81).

Then, at a time point when the cam unit 50 further rotates in a state in which the cap unit 30 is in the sealing position and the one atmosphere release valve 81 is opened, and the angle of rotation from the reference time point reaches about 95 degrees, the drive motor 70 switches the direction of rotation from the normal direction to the reverse direction. Consequently, while the rotation of the cam unit 50 is interrupted, the both of the two suction pumps 60 are activated as shown in FIG. 16. At this time, since the atmosphere release valve 80 corresponding to the cap member 31 at the one end is in the closed state, the internal space of the cap member 31 at the one end (that is, the waste ink receiving space partitioned by the cap member 31 at the one end and the nozzle surface 22) is isolated from the atmosphere. As a result of activation of the two suction pumps 60 in such a state, the suction pump 60 corresponding to the cap member 31 at the one end performs the closed suction. In other words, the internal space of the cap member 31 at the one end is brought into the negative pressure state, and ink is ejected from the respective nozzles Nz sealed by the cap member 31 at the one end.

In contrast, since the respective internal spaces of the remaining cap members 31 are in the atmosphere release state because the atmosphere release valve 81 corresponding to the respective remaining cap members 31 is in the opened state. Therefore, the suction pump 60 corresponding to the remaining cap members 31 performs the opened suction. With this opened suction, the waste ink generated by the above-described flushing operation and accumulated in the respective internal spaces of the remaining cap members 31 is sucked by the suction pump 60 corresponding to the remaining cap members 31.

After having operated the respective suction pumps 60 for a predetermined period, the drive motor 70 switches the direction of rotation again from the reverse direction to the normal direction. Accordingly, the suction pumps 60 are stopped and the cam unit 50 rotates again. Then, at a time point when the cam unit 50 rotates by about 105 degrees from the reference time point, the engaged portion 80*a* of the other atmosphere release valve 80 which is still in the closed state (that is, the atmosphere release valve 80 corresponding to the cap member 31 at the one end, and is indicated by an atmosphere release valve A in FIG. 16) engages the engaging portion 53*a* of the third cam 53 corresponding to the other atmosphere release valve 80 as shown in FIG. 16.

Figure 18C:
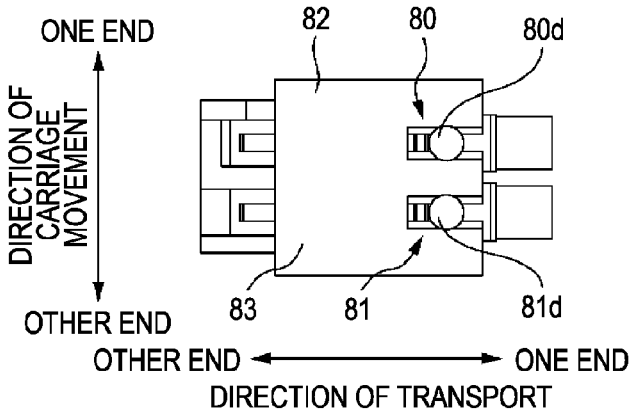
FIG. 18C is a drawing showing a state in which the other atmosphere release valve 80 is in the opened state.

Then, by the rotation of the cam unit 50, the third cam 53 corresponding to the other atmosphere release valve 81 rotates in the state in which the engaging portion 53*a* engages the engaged portion 80*a* of the other atmosphere release valve 80, so that the other atmosphere release valve 80 gradually opens. Then, as shown in FIG. 16, at a time point when the cam unit 50 rotates by about 110 degrees from the reference time point, the other atmosphere release valve 80 assumes a completely opened state. Accordingly, the internal space of the cap member 31 at the one end which used to be the negative pressure state (that is, the waste ink receiving space) is brought into the atmosphere release state. As shown in FIG. 18C, the one atmosphere release valve 81 is still in the opened state at a time point when the other atmosphere release valve 80 is brought into the opened state. Subsequently, the two atmosphere release valves 80 and 81 are both maintained in the opened state for a while. FIG. 18C is a drawing showing a state in which the other atmosphere release valve 80 is brought into the opened state, and a state in which the two atmosphere release valves 80 and 81 are both in the opened state.

In this embodiment, when the engaging portion 53*a* of the third cam 53 corresponding to the other atmosphere release valve 80 engages the engaged portion 80*a* of the other atmosphere release valve 80, the first cam 51 is positioned at the position apart from the elevating rack 130 in the direction of rotation thereof, and the second cam 52 is positioned at the position apart from the lowering rack 140 in the direction of rotation thereof. In this configuration, a timing when the third cam 53 corresponding to the other atmosphere release valve 80 rotates while engaging the other atmosphere release valve 80 is different from the timing when the first cam 51 rotates while engaging the elevating rack 130 and the timing when the second cam 52 rotates while engaging the lowering rack 140. Consequently, as described above, the load applied to the cam shaft 55 may be alleviated. As described above, the configuration in which the respective timings are shifted from each other is realized by adjusting the shapes of the first cam 51, the second cam 52, and the third cam 53 corresponding to the other atmosphere release valve 80, the relative positional relationship among the respective cams when viewed from the cam shaft 55, and the shapes or the positions of the respective engaged portions 130*a*, 140*a*, and 80*a* of the elevating rack 130, the lowering rack 140, and the other atmosphere release valves 80.

Then, at a time point when the cam unit 50 further rotates in the state in which the two atmosphere release valves 80 and 81 are opened and the angle of rotation from the reference time point reaches about 125 degrees, the direction of rotation of the drive motor 70 is switched again from the normal direction to the reverse direction. Accordingly, the rotation of the cam unit 50 is interrupted again, and the two suction pumps 60 are activated. At this time, since the both of the two atmosphere release valves 80 and 81 are in the opened state, the internal space of the cap member 31 at the one end and the internal spaces of the remaining cap members 31 are both in the atmosphere release state. Therefore, the two suction pumps 60 each perform the opened suction. Therefore, the waste ink generated by the cleaning operation and received in the internal space of the cap member 31 at the one end is sucked by the suction pump 60 corresponding to the cap member 31 at the one end. In contrast, the suction pump 60 corresponding to the remaining cap members 31 sucks continuously the waste ink accumulated in the respective internal spaces of the remaining cap members 31.

Subsequently, after having operated the suction pumps 60 for the predetermined period, the drive motor 70 switches the direction of rotation again from the reverse direction to the normal direction. In association with it, the suction pumps 60 are stopped, while the cam unit 50 rotates again. When the cam unit 50 rotates by about 145 degrees from the reference time point, the engaging state between the engaging portions 53*a* and 54*a* of the respective third cams 53 and 54 and the engaged portions 80*a* and 81*a* of the respective atmosphere release valves 80 and 81 are started to be released, and the two atmosphere release valves 80 and 81 are started to be closed substantially at the same time. Then, as shown in FIG. 16, at a time point when the cam unit 50 rotates by about 150 degrees from the reference time point, the two atmosphere release valves 80 and 81 assume a completely closed state.

At the time point when the cam unit 50 rotates by about 150 degrees from the reference time point, the second cam 52 reaches the position in which the engaging portion 52*a* of the second cam 52 engages the engaged portion 140*a* of the lowering rack 140 in the direction of rotation thereof. Subsequently, as a result of rotation of the second cam 52 in the state in which the engaging portion 52*a* engages the engaged portion 140*a* of the lowering rack 140 by the further rotation of the cam unit 50, the pressing force F2 that the second cam 52 presses the lowering rack 140 in the one direction is generated. Consequently, the slider drive mechanism 100 starts to perform the second movement, and the slider 41 moves rectilinearly in the other direction, and the cap unit 30 positioned at the sealing position starts to move downward toward the off position.

As described above, when the engaging portion 51*a* of the first cam 51 rotates while engaging the engaged portion 130*a* of the elevating rack 130, the engaging state between the engaging portion 52*a* of the second cam 52 and the engaged portion 140*a* of the lowering rack 140 is released. In other words, when the second cam 52 engages the lowering rack 140, and the first cam 51 is positioned at the position apart from the elevating rack 130 in the direction of rotation. Accordingly, when the slider drive mechanism 100 performs the second movement, the slider drive mechanism 100 performs the second movement adequately without being interfered with the first cam 51.

Then, while the cap unit 30 is lowered, the head 21 moves in the direction of movement of the head 21 so that the respective nozzle rows of the nozzle surface 22 are positioned right above the openings of the corresponding cap members 31. Subsequently, as shown in FIG. 16, at a time point when the cam unit 50 rotates by about 170 degrees from the reference time point, the above-described flushing operation is performed again, and the ink is forcedly ejected from the respective nozzles Nz. The flushing operation performed after the cleaning operation (post-cleaning flushing) is an operation for putting the meniscuses formed at the openings of the respective nozzles in order. Then, the waste ink generated by the post-cleaning flushing is received in the internal spaces of the cap members 31 corresponding to the respective nozzles Nz from which the waste ink is ejected (the cap members 31 positioned right below the respective nozzles Nz) as in a case of the flushing operation performed before the cleaning operation (pre-cleaning flushing). When the post-cleaning flushing is being performed, since the cap unit 30 is in the course of lowering, the cap members 31 receive the waste ink generated by the post-cleaning flushing in the internal spaces thereof while lowering.

While the cam unit 50 further rotates, the post-cleaning flushing is ended, while the second cam 52 continues to rotate in the state in which the engaging portion 52*a* thereof engages the engaged portion 140*a* of the lowering rack 140. Consequently, the slider drive mechanism 100 continuously moves the slider 41 rectilinearly in the other direction by the second movement, and the cap unit 30 moves further downward. Then, as shown in FIG. 16, the cap unit 30 reaches the off position in the vertical direction and the second movement by the slider drive mechanism 100 is ended at a time point when the cam unit 50 rotates by about 210 degrees from the reference time point (in other words, the rectilinear movement of the slider 41 in the other direction is ended).

Then, the direction of rotation of the drive motor 70 is switched again from the normal direction to the reverse direction at a time point when the cap unit 30 reaches the off position, and the rotation of the cam unit 50 is interrupted, and the two suction pumps 60 are activated. At this time, since the respective cap members 31 are apart from the nozzle surface 22 of the head 21, the openings of the cap members 31 face the atmosphere. In other words, at this time, the internal spaces of the respective cap members 31 are in the atmosphere release state. Therefore, the two suction pumps 60 each perform the opened suction, and suck the waste ink generated by the post-cleaning flushing and accumulated in the internal spaces of the respective cap members 31.

After having operated the respective suction pumps 60 for the predetermined period, the drive motor 70 switches the direction of rotation from the reverse direction to the normal direction and, in association with it, the suction pumps 60 are stopped while the cam unit 50 starts to rotate. Subsequently, at a time point when the cam unit 50 rotates by 360 degrees (that is, one turn) from the reference time point, the drive motor 70 is stopped. Accordingly, the respective portions of the cam unit 50 return to positions in the direction of rotation where they are positioned at the reference time point.

At a time point when the above-described series of operations is completed, the operation of the maintenance unit 24 (the operation to perform the cleaning operation once) is ended. In contrast, the head 21 waits for the next ink ejecting operation (the ink ejecting operation as the operation for the image forming process) in a state of staying at the home position. In the above-described description, the flushing operation is performed respectively before and after the cleaning operation. However, the invention is not limited thereto and, for example, a configuration in which only one of the pre-cleaning flushing and the post-cleaning flushing is performed is also applicable.

Effectiveness of Printer 11 in the Embodiment

In the printer 11 provided with the maintenance unit 24 described above, the direction of the rectilinear movement of the slider 41 may be switched smoothly. Accordingly, the operation to move the cap unit 30 to the sealing position and causes the cap unit 30 to seal the nozzles Nz for the cleaning operation and the operation to move the cap unit 30 away from the nozzles Nz after the cleaning operation are performed smoothly as a series of operations. The effectiveness of the printer 11 in the embodiment will be described in further detail.

As described already in the paragraphs of BACKGROUND, a configuration in which the slider 41 is provided in the cap elevating unit 40 for moving the cap unit 30 in the vertical direction is already known. The slider 41 guides the cap unit 30 to the sealing position by moving rectilinearly in the one direction which is on the two directions opposite from each other and intersecting the vertical direction, and guides the cap unit 30 to the off position by moving rectilinearly in the other direction.

As in this embodiment, the slider 41 may have the groove cams 42 which engage the projecting portions 33 provided on the cap unit 30 (more specifically, the side walls 32*a* of the cap holder 32). The groove cams 42 each have the portion inclined with respect to the horizontal direction, and the slider 41 elevates the cap unit 30 to the sealing position by moving the projecting portions 33 to the one groove cam ends 42*e* along the groove cams 42 when moving rectilinearly in the one direction. In contrast, the slider 41 lowers the cap unit 30 to the off position by moving the projecting portions 33 to the other groove cam ends 42*f* along the groove cams 42 when moving rectilinearly in the other direction.

The slider 41 as described above is suitable as a member to move the cap unit 30 in the vertical direction. For example, the slider 41 in this embodiment is downsized as a came which realizes the vertical movement of the cap unit 30 in comparison with a cylindrical cam which moves the cap unit 30 in the vertical direction by rotating while coming into abutment with the lower surface of the cap unit 30 (more specifically, the cap holder 32). Furthermore, with the slider 41 in this embodiment, in a case where the contact surface area between the cap unit 30 and the nozzle surface 22 becomes relatively large, the contact pressure according to the contact surface area may be secured adequately. In other words, with the slider 41 in this embodiment, the load which is inevitably generated when securing the contact pressure may be reduced.

There is a case in which the printer 11 is provided with the drive motor 70, the slider drive mechanism 100 configure to make the slider 41 to move rectilinearly by the drive force from the drive motor 70, and a cam unit configured to transmit the drive force to the slider drive mechanism 100 by rotating in a state of engaging the slider drive mechanism 100 in association with the rotation of the drive motor 70 for moving the slider 41 rectilinearly. The slider drive mechanism 100 performs the first movement which moves the slider 41 rectilinearly in the one direction and the second movement which moves the slider 41 rectilinearly in the other direction. In contrast, in both in a case where the slider drive mechanism 100 performs the first movement and in a case where the slider drive mechanism 100 performs the second movement, the cam unit rotates while engaging the slider drive mechanism 100 for transmitting the drive force from the drive motor 70 to the slider drive mechanism 100.

As the cam unit described above, for example, a cam unit which switches the direction of rotation for switching the operation of the slider drive mechanism 100 from the first movement to the second movement (or the second movement to the first movement) (which is different from the cam unit 50 in this embodiment and is referred to as the other cam unit) is contemplated. However, with the configuration in which the direction of rotation is switched to switch the operation of the slider drive mechanism 100 as the other cam unit, the switching operation of the direction of rotation is complicated, so that a significant time is required for the switching operation. In other words, smooth switching of the direction of the rectilinear movement of the slider 41 becomes difficult. Consequently, the operation to move the cap unit 30 to the sealing position when performing the cleaning operation and the operation to move the cap unit 30 away from the nozzles Nz after the cleaning operation are not performed smoothly as a series of operations, so that the processing speed of the printer 11 may be lowered.

In contrast, the cam unit 50 in this embodiment rotates in the same direction of rotation both in a case where the drive force from the drive motor 70 is transmitted to the slider drive mechanism 100 when the slider drive mechanism 100 performs the first movement, and in a case where the drive force is transmitted to the slider drive mechanism 100 when the slider drive mechanism 100 performs the second movement. More specifically, the cam unit 50 in this embodiment includes the first cam 51 having the engaging portion 51*a* which engages the engaged portion 130*a* of the elevating rack 130 and the second cam 52 having the engaging portion 52*a* which engages the engaged portion 140*a* of the lowering rack 140. Then, the engaging state between the respective engaged portions 130*a* and 140*a* of the elevating rack 130 and the lowering rack 140 and the engaging portions 51*a* and 52*a* of the first cam 51 and the second cam 52 is switched while the cam unit 50 rotates in the predetermined direction of rotation. More specifically, when the cam unit 50 rotates in the predetermined direction of rotation, the combination of the rack and cam in the engaging state is switched.

In this manner, in this embodiment, when the slider 41 switches the direction of the rectilinear movement, it is not necessary to switch the direction of rotation of the cam unit 50, and the time to switch the direction of rotation is not necessary as well. Accordingly, the direction of the rectilinear movement of the slider 41 may be switched smoothly. In other words, the operation to move the cap unit 30 to the sealing position when performing the cleaning operation and the operation to move the cap unit 30 away from the nozzles Nz after the cleaning operation are performed smoothly as the series of operations.

Also, in order to realize the cam unit 50 which does not need the switching of the direction of rotation when switching the direction of the rectilinear movement of the slider 41, the configuration of this embodiment is such that the combination of the rack and cam in the engaging state is switched by the rotation of the cam unit 50 in the predetermined direction. More specifically, the cam which transmits the drive force from the drive motor 70 to the slider drive mechanism 100 by rotating while engaging the slider drive mechanism 100 is divided into the cam which rotates by engaging the slider drive mechanism 100 when causing the slider 41 to move rectilinearly in the one direction (that is, the first cam 51) and the cam which rotates by engaging the slider drive mechanism 100 when causing the slider 41 to move rectilinearly in the other direction (that is, the second come 52). In addition, in the slider drive mechanism 100, the portions which engage the first cam 51 and the second cam 52 (that is, the engaged portions 130*a* and 140*a* of the elevating rack 130 and the lowering rack 140) are provided separately for the respective cams. Consequently, the direction in which the slider 41 moves rectilinearly may be switched smoothly with a relatively simple configuration in this embodiment.

Other Embodiment

Although the printer 11 as the liquid ejecting apparatus has mainly been described on the basis of the embodiment as described above, the embodiment of the present invention as described above is simply for facilitating the understanding of the invention, and is not intended to limit the invention. The invention may be modified or improved without departing the scope of the invention, and the invention includes equivalents as a matter of course.

Although the printer 11 is configured to eject the ink as an example of the liquid in the embodiment as describe above, the ink may be water based ink or may be solvent ink. Although the printer 11 which ejects ink has been described in the above-described embodiment, the invention is not limited thereto, and a liquid ejecting apparatus which ejects other types of liquid may be contemplated. In other words, the invention may be embodied in the liquid ejecting apparatus which ejects liquid other than the ink (including liquid type substances including particles of functional material dispersed or mixed therein, or fluid type substances such as gel other than the liquid).

For example, liquid ejecting apparatuses which eject liquid type substances containing electrode material or colorant in the form of dispersion or dissolution used for manufacturing liquid crystal displays, EL (electroluminescence) displays, or surface emission-type displays, liquid ejecting apparatuses which eject biological organic substance used for manufacturing biochips, or liquid ejecting apparatuses which are used as accurate pipettes and eject liquid as a sample may also be applicable. Furthermore, it may be liquid ejecting apparatuses which eject lubricant for pinpoint lubrication for precise machines such as watches or cameras, liquid ejecting apparatuses which eject transparent resin liquid such as UV-cured resin on a substrate for forming micro-semispherical lens (optical lens) or the like used for optical communication elements or the like, liquid ejecting apparatuses which eject etching liquid such as acid or alkali for etching the substrate or the like, or a fluid-like substance ejecting apparatus which eject gel. The invention may be applied to any one of the liquid ejecting apparatuses.

The entire disclosure of Japanese Patent Application No. 2008-151940, filed Jun. 10, 2008 is expressly incorporated by reference herein.

What is claimed is:

1. A liquid ejecting apparatus comprising:

a head configured to eject liquid;

a sealing unit configured to seal the head, the sealing unit moving between a sealing position for sealing the head in a direction of movement and an off position apart from the head;

a slider configured to guide the sealing unit to the sealing position by moving rectilinearly in one direction of two directions which are directions opposite from each other and intersecting the direction of movement and guide the sealing unit to the off position by moving rectilinearly in the other direction;

a motor;

a drive mechanism configured to perform a first movement for moving the slider rectilinearly in the one direction and a second movement for moving the slider rectilinearly in the other direction by a drive force from the motor; and a drive force transmitting unit configured to transmit the drive force to the drive mechanism by rotating in a state of engaging the drive mechanism in association with the rotation of the motor, the drive force transmitting unit rotating in the same direction of rotation both in a case of transmitting the drive force to the drive mechanism when the drive mechanism performs the first movement and in a case of transmitting the drive force to the drive mechanism when the drive mechanism performs the second movement.

2. The liquid ejecting apparatus according to claim 1, wherein the sealing unit includes a side wall opposing the slider, the side wall includes a projecting portion projecting outward of the side wall, the slider includes a groove cam with which the projecting portion engages, the sealing unit is guided to the sealing position by moving the projecting portion to one end of the groove cam along the groove cam when moving rectilinearly in the one direction, and the sealing unit is guided to the off position by moving the projecting portion to the other end of the groove cam along the groove cam when moving rectilinearly in the other direction.

3. The liquid ejecting apparatus according to claim 1, wherein the drive force transmitting unit includes:

a first cam configured to transmit the drive force to the drive mechanism by rotating in a state of engaging the drive mechanism when the drive mechanism performs the first movement;

a second cam configured to transmit the drive force to the drive mechanism by rotating in a state of engaging the drive mechanism when the drive mechanism performs the second movement: and a cam shaft configured to support the first cam and the second cam and rotate integrally with the first cam and the second cam in association with the rotation of the motor and the drive force transmitting unit rotates in the same direction of rotation both in a case of rotating in the state in which the first cam engages the drive mechanism and the case of rotating in the state in which the second cam engages the drive mechanism.

4. The liquid ejecting apparatus according to claim 3, wherein where one of the first cam and the second cam engages the drive mechanism, the other cam is positioned apart from the drive mechanism.

5. The liquid ejecting apparatus according to claim 4, wherein the drive mechanism includes:

a first rack provided on the slider to be interlocked with the slider;

a composite gear having a large gear which engages the first rack and a small gear, the composite gear rotating in a normal direction to cause the first rack to move rectilinearly in the one direction and rotating in a reverse direction to cause the first rack to move rectilinearly in the other direction; and a pair of second racks engaging the small gear in a state of opposing to each other, the one second rack moving rectilinearly in the one direction to rotate the composite gear in the normal direction and the other second rack moving rectilinearly in the one direction to rotate the composite gear in the reverse direction, wherein the first cam rotates in a state of engaging the one second rack to cause the one second rack to move rectilinearly in the one direction, and the second cam rotates in a state of engaging the other second rack to cause the other second rack to move rectilinearly in the one direction.

6. The liquid ejecting apparatus according to claim 4, comprising a suction pump configured to suck the liquid from the heads by bringing spaces formed between the sealing unit and heads into a negative pressure state when the sealing unit seals the heads, wherein the motor is rotatable in both the normal direction and the reverse direction, the cam shaft rotates in association with the rotation of the motor in the normal direction, and the suction pump is activated in association with the rotation of the motor in the reverse direction.

7. The liquid ejecting apparatus according to claim 6, comprising:

an atmosphere release valve configured to bring the space in the negative pressure state into an atmosphere release state; and a third cam configured to open the atmosphere release valve by rotating in a state of engaging the atmosphere release valve, wherein the third cam being supported by the cam shaft rotates integrally with the cam shaft and engages the atmosphere release valve while the first cam and the second cam are apart from the drive mechanism.

* * * * *